US007171770B2

(12) United States Patent
Schultz et al.

(10) Patent No.: US 7,171,770 B2
(45) Date of Patent: Feb. 6, 2007

(54) TRIP EDGE SNOW PLOW BLADE

(75) Inventors: Lynn W. Schultz, Campbellsport, WI (US); Ann M. Schmid, Grafton, WI (US); Robert N. Gamble, II, Watertown, WI (US); Terry C. Wendorff, Slinger, WI (US)

(73) Assignee: Sno-Way International, Inc., Hartford, WI (US)

( * ) Notice: Subject to any disclaimer, the term of this patent is extended or adjusted under 35 U.S.C. 154(b) by 207 days.

(21) Appl. No.: 10/925,806

(22) Filed: Aug. 25, 2004

(65) Prior Publication Data

US 2006/0042128 A1 Mar. 2, 2006

(51) Int. Cl.
*E01H 5/04* (2006.01)

(52) U.S. Cl. ..... 37/232; 37/266

(58) Field of Classification Search ..... 37/266, 37/271–272, 232

See application file for complete search history.

(56) References Cited

U.S. PATENT DOCUMENTS 3,014,289 A 12/1961 Torrey
4,259,794 A * 4/1981 Rath ..... 37/233
4,307,523 A * 12/1981 Reissinger et al. ..... 37/233
4,794,710 A * 1/1989 Haring ..... 37/232
5,191,729 A 3/1993 Verseef
5,353,530 A 10/1994 Pieper
5,437,113 A 8/1995 Jones
5,697,172 A 12/1997 Verseef
2005/0120594 A1* 6/2005 Hollinrake et al. ..... 37/266

OTHER PUBLICATIONS

"The Boss Snow Plow" Brochure, Form #411, 2003, Boss Products/Northern Star Industries, Inc.
"Fisher Snowplows" Brochure, Form No. 002-006, 2000, Fisher Engineering, a division of Douglas Dynamics, LLC.
"Hiniker HDX Snow Plows" Brochure, Apr. 2003, Hiniker Company.

* cited by examiner

*Primary Examiner*—Thomas A Beach
(74) *Attorney, Agent, or Firm*—Reinhart Boerner Van Deuren s.c.

(57) ABSTRACT

An improved snow plow blade is disclosed which has a fixed upper plow blade and a pivoting lower trip blade mounted on the swing frame of the snow plow with the axis of rotation of the trip blade being directly in line with the swing frame and the support frame of the snow plow. Since the axis of rotation of the trip edge blade is located at the height of the vertical center of the swing frame (and is thereby in the same horizontal plane), the forces imparted to the swing frame will be essentially compressive in nature rather than including a torsional element as well. The trip edge blade and the trip edge springs used to bias the trip edge blade into an untripped position are substantially supported by the swing frame of the snow plow rather than being supported from the upper plow blade. The trip edge blade is also sufficiently high to prevent damage to the upper snow plow blade due to impacts with curbs or other high obstacles.

28 Claims, 14 Drawing Sheets

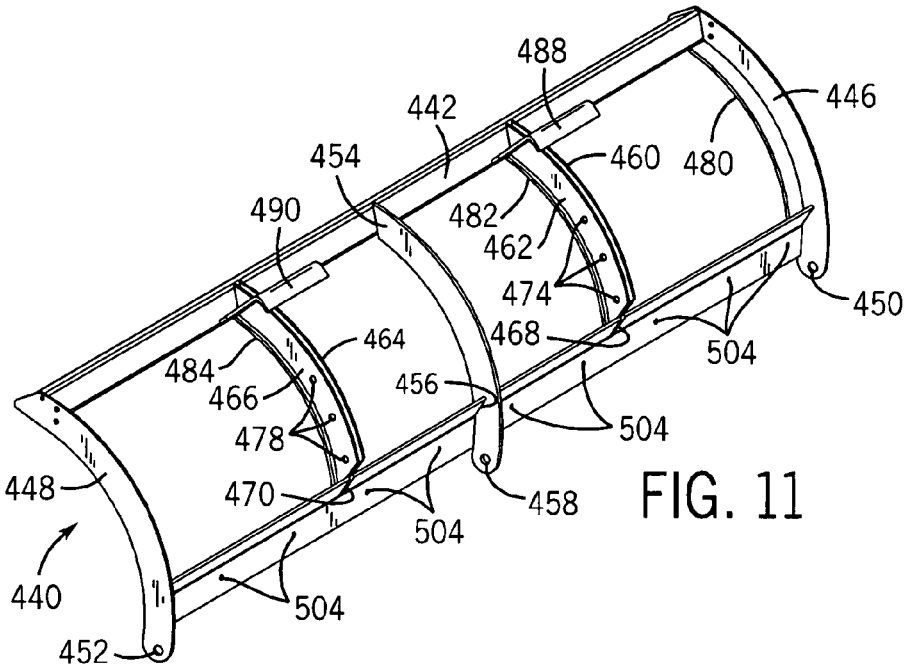
FIG. 11
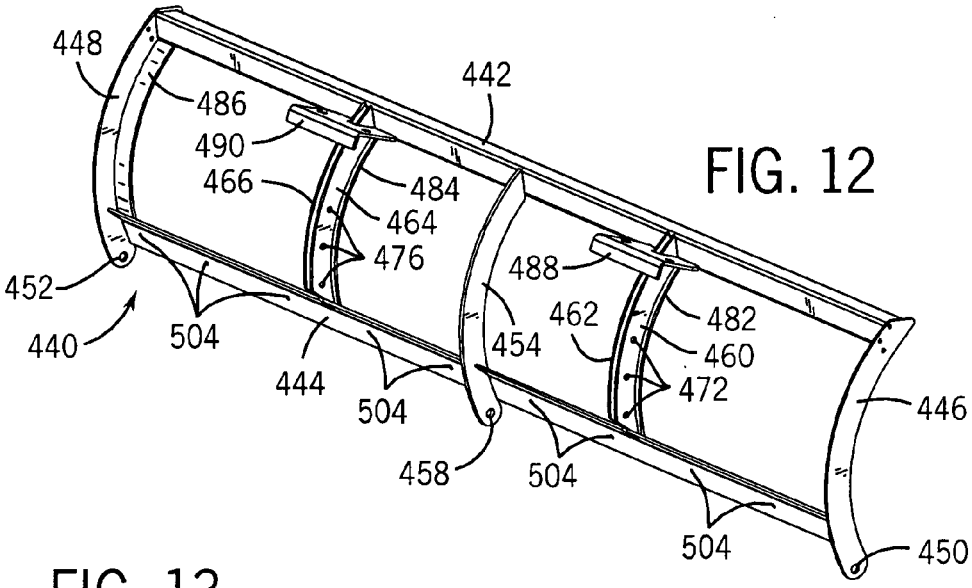
FIG. 12
FIG. 13
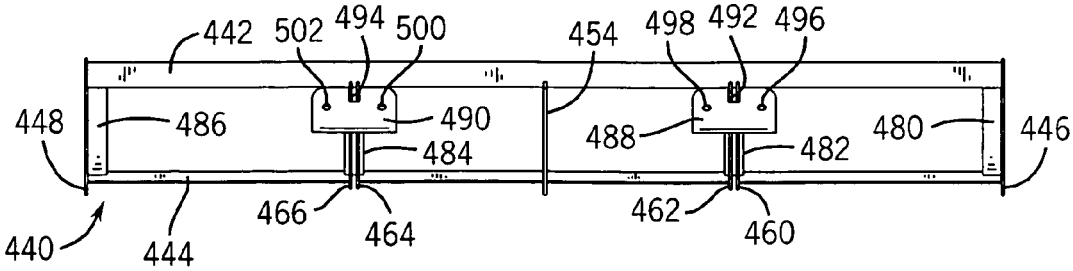

TRIP EDGE SNOW PLOW BLADE

BACKGROUND OF THE INVENTION

Field of the Invention

The present invention relates generally to snow plows for use with light and medium duty trucks, and more particularly to an improved snow plow blade having a fixed upper plow blade and a pivoting lower trip blade mounted on the swing frame of the snow plow with the axis of rotation of the trip blade being directly in line with the swing frame and the support frame of the snow plow.

Once the exclusive domain of municipality-operated heavy trucks, snow plows have been used with light and medium duty trucks for decades. As would be expected in any area of technology which has been developed for that period of time, snow plows for light and medium duty trucks have undergone tremendous improvement in a wide variety of ways over time, evolving to increase both the usefulness of the snow plows as well as to enhance the ease of using them. The business of manufacturing snow plows for light and medium duty trucks has been highly competitive, with manufacturers of competing snow plows differentiating themselves based on the features and enhanced technology that they design into their products.

When plowing snow, a not infrequent occurrence is striking an object which is concealed beneath the snow. This occurs particularly often when plowing roads which are not paved, such as, for example, gravel roads or dirt roads. Since roads being plowed are typically frozen, it is common for an object of significant size to become frozen into the road. For example, medium size rocks or sticks which would not present a significant obstacle were they loose on the surface of the road can present a problem when they are frozen into the surface of the road and concealed beneath a layer of snow. In addition, when significant snow depth covers the area being plowed, the operator may miscalculate and drive the snow plow into a fixed obstacle such as a curb.

For this reason, snow plow blades have been manufactured for some time with a blade trip mechanism which allows the bottom of the blade to yield upon substantial impact. This is accomplished in one of two different types of implementation: 1. the snow plow blade is mounted on its support structure using a pivoting mechanism where the entire snow plow blade pivots when the bottom of the snow plow blade encounters an obstacle; or 2. a trip blade is hingedly mounted at the bottom of an upper blade and pivots when it encounters an obstacle. In the first type of mechanism, the snow plow blade is mounted onto the support structure at a position between eight and sixteen inches above the ground in a manner which permits the bottom of the snow plow blade to pivot back when an object is struck. Simultaneously as the bottom of the snow plow blade pivots back, the top of the snow plow blade will pivot forward.

This movement between the normal plowing position of the snow plow blade to the position in which the bottom of the snow plow blade pivots fully backward is referred to as blade tripping. The movement of the snow plow blade from the normal plowing position to the tripped position is resisted by two or more strong trip springs which are mounted behind the snow plow blade, typically running from positions near the top of the snow plow blade to the snow plow blade support structure. Even when the snow plow blade is in its normal plowing position, the trip springs are under tension. Accordingly, it will be appreciated that when the bottom of the snow plow blade is forced backward, the trip springs will provide a strong resistance to the movement, tending to absorb some of the force of the impact of the snow plow blade with the object which has been struck.

In a typical embodiment, the snow plow blade is supported at two pivot points on the right and left sides of the snow plow blade by a swing frame. The snow plow blade has a plurality of vertically extending curved ribs which are connected between top and bottom plow frame members, and two of these ribs have apertures located between approximately eight and sixteen inches from the bottom of the snow plow blade. The snow plow blade is pivotally mounted to the swing frame using these apertures. The trip springs are mounted between the snow plow blade and the swing frame to provide the tripping resistance force.

The trip springs are mounted to the snow plow blade using apertures located either in the ribs or in the top frame member, or using brackets mounted onto one or more of these members. The trip springs may be mounted at one end to the top frame member and the ribs from which the snow plow blade is pivotally supported. The other ends of each of the trip springs are mounted to the snow plow blade support structure, typically using brackets which may be mounted, for example, on the swing frame. The points of connection of the trip springs on the swing frame or other snow plow blade support structure are typically located closer to the center of the snow plow than is the point of connection of the trip springs to the snow plow blade.

Although the predominant force exerted by the trip springs on the snow plow blade is orthogonal to the axis on which the snow plow blade pivots, a significant portion of the force is exerted in a lateral direction which is parallel to that axis. This component of the spring force is detrimental to the structural integrity of the snow plow blade frame, which is not constructed to resist forces in a lateral direction. Although the trip springs are located on both sides of the snow plow blade, and the lateral forces exerted by them thus tend to offset, over time their presence can cause blade distortion or other damage. In addition, it will be appreciated by those skilled in the art that since not all of the force exerted by the trip springs is in the direction orthogonal to the axis on which the snow plow blade pivots, the trip springs must be larger in order to provide the desired force in this orthogonal direction than they would otherwise be if all of the force which they exerted were in this orthogonal direction.

An improved version of the first type of blade tripping mechanism in which the entire blade pivots is illustrated in U.S. Pat. No. 6,701,646, to Schultz et al., which is assigned to the assignee of the present invention. This patent discloses an improved snow plow which has blade trip springs which are mounted using brackets located to direct the force of the springs in directions which are orthogonal to the axis upon which the plow blade pivots, thereby increasing the predictability of the tripping forces exerted by the trip springs as well as eliminating lateral trip spring forces which could warp the plow blade. The forces exerted by the trip springs are exerted proximate planes which are orthogonal to the pivot points at which the snow plow blade is mounted to the snow plow blade support structure. Either a single trip spring on either side of the snow plow blade or two trip springs on each side of the snow plow blade are used, with the size of the trip springs being minimized by ensuring that all of the forces which they exert are directed properly in the requisite directions. U.S. Pat. No. 6,701,646 is hereby incorporated herein by reference in its entirety.

In the second type of mechanism mentioned above, a trip blade is hingedly mounted at the bottom of an upper blade which is supported from the chassis of the plow, and when the trip blade encounters an obstacle, only the trip blade pivots. Examples of such trip edge snow plow blades are found in U.S. Pat. No. 5,191,729, to Verseef; U.S. Pat. No. 5,353,530, to Pieper; U.S. Pat. No. 5,437,113, to Jones; and U.S. Pat. No. 5,697,172, to Verseef. These presently known trip edge snow plow blades all possess several disadvantages, which will be discussed in the following paragraphs.

First, presently known trip edge snow plow blades all mount the top of the trip edge blade from the bottom of the upper blade. This subjects the upper blade to substantial forces which can cause blade distortion or other damage, or which alternately require substantially heavier construction, which in turn is disadvantageous both in terms of cost to purchase and operate, and also in terms of plow performance. In addition, many of the presently known trip edge designs have the hinge mechanism between the trip edge blade and the upper snow plow blade fully exposed at the front of the snow plow blade, where the hinge mechanism is highly susceptible to damage due to impact with obstacles.

Second, presently known trip edge snow plow blades have their axis of rotation located in a horizontal plane which is not aligned with the supporting frame of the snow plow, thereby causing rotational torque to be imparted to the supporting frame of the snow plow. Since most presently known trip edge snow plow blades have a trip edge blade which is five or six inches high (12.7 to 15.24 cm high), which means that the axis of rotation of the trip edge blade is below the level of the supporting frame of the snow plow, this rotational torque will add to the normal compressive forces present in the mechanical linkage between the supporting frame of the snow plow and the blade of the snow plow, causing additional stresses and wear. This undesirable situation is compounded by the fact that most presently known snow plows already have rotational torque due to the fact that the snow plow blade is mounted below the level of the supporting frame of the snow plow.

Third, presently known trip edge snow plow blades for the most part are highly susceptible to damage caused by hitting a snow-covered curb which is not visible to the driver of the truck on which the snow plow is mounted. This is due to the fact that most commercially-available snow plows have a short trip edge blade as mentioned above—typically only five or six inches high (12.7 to 15.24 cm high) when the snow plow is operated with a new wearstrip at the bottom edge of the trip edge blade. When this wearstrip wears down, the actual height of the trip edge blade will be even lower. Since most curbs are made at a standard height of six inches (15.24 cm), it will be at once appreciated by those skilled in the art that if a snow plow blade with such a short trip edge blade runs into a curb, the tripe edge blade will be tripped, but the bottom of the upper blade will also strike the curb, potentially causing significant damage to the snow plow blade.

It is accordingly the primary objective of the present invention that it provide a trip edge snow plow blade which is mounted onto the swing frame of the snow plow so that the swing frame, and thus the supporting frame of the snow plow, provides at least a substantial portion of the support for the trip edge snow plow blade. It is a related objective of the present invention that forces inherent in the tripping action of the trip edge snow plow blade be transmitted directly to the swing frame and the supporting frame of the snow plow rather than being transmitted to the upper snow plow blade. It is a further objective of the present invention that the hinge mechanism used to pivotally mount the trip edge snow plow blade is not exposed at the front of the snow plow blade where it would be susceptible to potential damage caused by objects struck by the snow plow.

It is another objective of the present invention that the axis of rotation of the trip edge snow plow blade be located at the height of the supporting frame of the snow plow in order to prevent the creation of torsional forces and to ensure that the load imparted to the supporting frame be substantially compressive in nature. It is still another objective of the present invention that the forces of the springs which bias the trip edge snow plow blade into an untripped position be carried by the swing frame of the snow plow rather than being exerted upon the upper snow blow blade. It is yet another objective of the present invention that the trip edge snow plow blade be substantially higher than the height of most previously known trip edge blades to prevent damage to the upper snow plow blade due to impacts with curbs or other high obstacles.

The trip edge snow plow blade of the present invention must also be of construction which is both durable and long lasting, and it should also require little or no maintenance to be provided by the user throughout its operating lifetime. In order to enhance the market appeal of the trip edge snow plow blade of the present invention, it should also be of relatively inexpensive construction to thereby afford it the broadest possible market. Finally, it is also an objective that all of the aforesaid advantages and objectives of the trip edge snow plow blade of the present invention be achieved without incurring any substantial relative disadvantage.

SUMMARY OF THE INVENTION

The disadvantages and limitations of the background art discussed above are overcome by the present invention. With this invention, a trip edge snow plow blade is provided which departs from previously known trip edge snow plow blades in three respects: 1. the trip edge blade of the trip edge snow plow blade of the present invention is substantially supported by the swing frame of the snow plow rather than being supported from the upper plow blade; 2. the trip edge springs used to bias the trip edge blade into an untripped position are supported by the swing frame rather than being mounted on the upper plow blade; and 3. the trip edge blade is approximately ten inches (25.4 cm) high.

The swing frame of the trip edge snow plow blade of the present invention has two curved blade mounting brackets at opposite sides thereof which are used to support both an upper or top plow blade and a trip edge blade. The top plow blade is based upon a frame having horizontal top and bottom members and a plurality of vertical curved ribs extending therebetween, including two pairs of blade attach ribs. When the top plow blade frame is mounted onto the swing frame, a pair of blade attach ribs are bolted onto opposite sides of each of the blade mounting brackets on the swing frame. These pairs of blade attach ribs together with the blade mounting brackets which they encase, form a rigid support member. The brackets which will support the top ends of the trip edge springs are mounted on the pairs of blade attach ribs, and thus are essentially supported from the swing frame, and will not exert force upon the top plow blade.

The trip edge blade is also based upon a frame having horizontal top and bottom members and a plurality of vertical ribs extending therebetween, including two pairs of blade pin ribs which will be pivotally mounted onto the lower portions of the blade mounting brackets on the swing frame. Thus, the trip edge blade is supported for pivotal movement from the swing frame rather than from the frame of the top snow plow blade. In the preferred embodiment, the trip edge blade also includes pivotal connections to the frame of the top snow plow blade to support it in the proper position below the top snow plow blade, but the locations of the trip edge springs are at the support locations mounted on the swing frame.

The two pairs of blade pin ribs each have a rearwardly-extending arm, with the lower ends of the trip edge springs being mounted to these arms. The trip edge springs bias the trip edge blade to a forward or untripped position, and when the bottom of the trip edge blade is forced rearwardly, the trip edge blade pivots to a tripped position, compressing the trip edge springs. The locations of the rearwardly-extending arms on the blade pin ribs and the angle at which the rearwardly-extending arm extend from the blade pin ribs, together with the geometry of their connection to the trip edge springs, are designed to provide a substantially linear progressively increasing force to the trip edge blade as it moves from the untripped position to the fully tripped position, unlike the force applied by previously known trip edge plows, which flattens out and then drops off with increasing deflection of the trip edge blade.

The tripping mechanism has limits which are maintained by the mechanical design of the blade mounting brackets on the swing frame. In the preferred embodiment, the trip edge springs are oriented in vertical planes, and as such do not exert any lateral forces. The preload on the trip edge springs is adjustable to vary the amount of bias the trip edge springs exert on the trip edge blade. In the preferred embodiment, two pairs of trip edge springs are used on the trip edge snow plow blade.

The height of the trip edge blade in the preferred embodiment is approximately ten inches (25.4 cm), which is substantially higher than the five to six inches (12.7 to 15.24 cm) of previously known trip edge blades. As such, the trip edge blade of the present invention includes a wearstrip on the lower portion thereof, with a blade skin being used to cover the upper portion thereof. This results in two advantages, the first of which is that the height of the trip edge blade is substantially higher than typical curbs, and the bottom of the top plow blade will thus be located well above the level of curbs to prevent damage thereto when the trip edge blade trips upon impact with a curb. The other advantage is the geometric layout of the moment arm of the trip edge blade, which for an equivalent rearward tripping movement requires less movement of the trip edge springs.

In addition, the design of the swing frame is such that the axis of rotation of the trip edge blade, which is pivotally mounted on the blade mounting brackets of the swing frame, is located at the height of the vertical center of the swing frame (and is thereby in the same horizontal plane), thereby ensuring that the forces imparted to the swing frame will be essentially compressive in nature rather than including a torsional element as well. Since in the preferred embodiment the supporting frame of the snow plow is also in the same plane as the swing frame, those skilled in the art will appreciate that compressive forces are maintained throughout the trip edge snow plow blade of the present invention.

It may therefore be seen that the present invention teaches a trip edge snow plow blade which is mounted onto the swing frame of the snow plow so that the swing frame, and thus the supporting frame of the snow plow, provides at least a substantial portion of the support for the trip edge snow plow blade. Accordingly, the forces inherent in the tripping action of the trip edge snow plow blade are transmitted directly to the swing frame and the supporting frame of the snow plow rather than being transmitted to the upper snow plow blade. In addition, the hinge mechanism used to pivotally mount the trip edge snow plow blade of the present invention is not exposed at the front of the snow plow blade where it would be susceptible to potential damage caused by objects struck by the snow plow.

The axis of rotation of the trip edge snow plow blade of the present invention is located at the height of the supporting frame of the snow plow in order to prevent the creation of torsional forces and to ensure that the load imparted to the supporting frame be substantially compressive in nature. The forces of the springs which bias the trip edge snow plow blade of the present invention into an untripped position are carried by the swing frame of the snow plow rather than being exerted upon the upper snow blow blade. The trip edge blade portion of the trip edge snow plow blade of the present invention is also substantially higher than the height of most previously known trip edge snow plow blades to prevent damage to the upper snow plow blade due to impacts with curbs or other high obstacles.

The trip edge snow plow blade of the present invention is of a construction which is both durable and long lasting, and which will require little or no maintenance to be provided by the user throughout its operating lifetime. The trip edge snow plow blade of the present invention is also of relatively inexpensive construction to enhance its market appeal and to thereby afford it the broadest possible market. Finally, all of the aforesaid advantages and objectives of the trip edge snow plow blade of the present invention are achieved without incurring any substantial relative disadvantage.

DESCRIPTION OF THE DRAWINGS

These and other advantages of the present invention are best understood with reference to the drawings, in which:

FIG. 11 is an isometric view of a top plow blade frame constructed according to the teachings of the present invention, shown from the left side and the rear;

FIG. 12 is an isometric view of the top plow blade frame illustrated in FIG. 11, shown from the right side and the rear;

FIG. 13 is a top plan view of the top plow blade frame illustrated in FIGS. 11 and 12;

DETAILED DESCRIPTION OF THE PREFERRED EMBODIMENT

Figure 27:
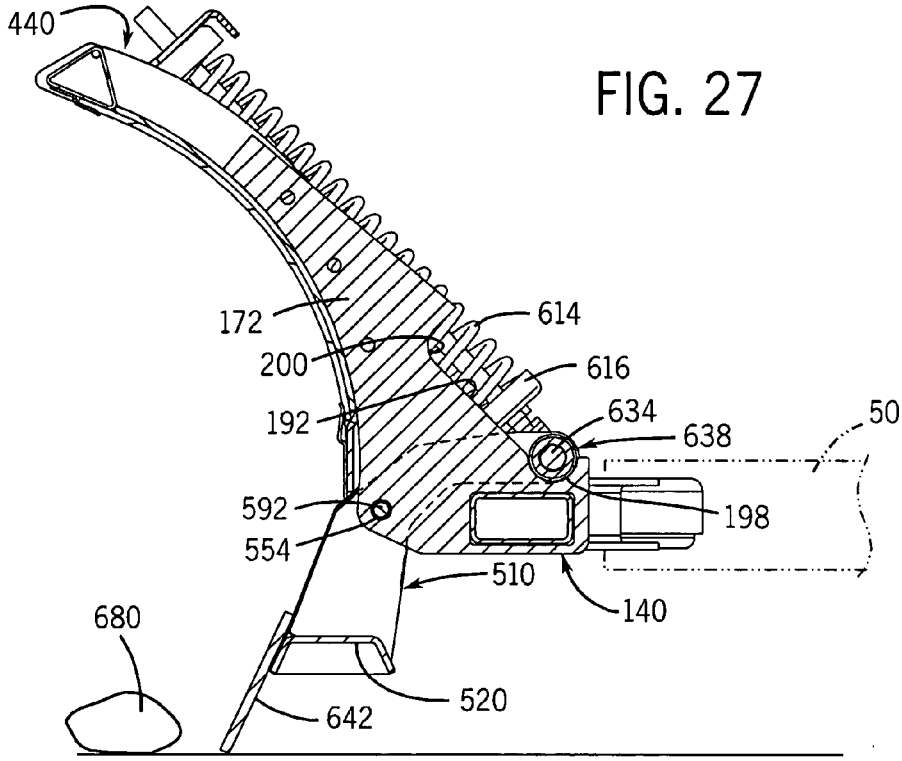
FIG. 27 is a cross-sectional view of the apparatus illustrated in FIGS. 23 and 24, showing the trip edge snow plow blade and the spring assemblies in a first untripped position.
Figure 28:
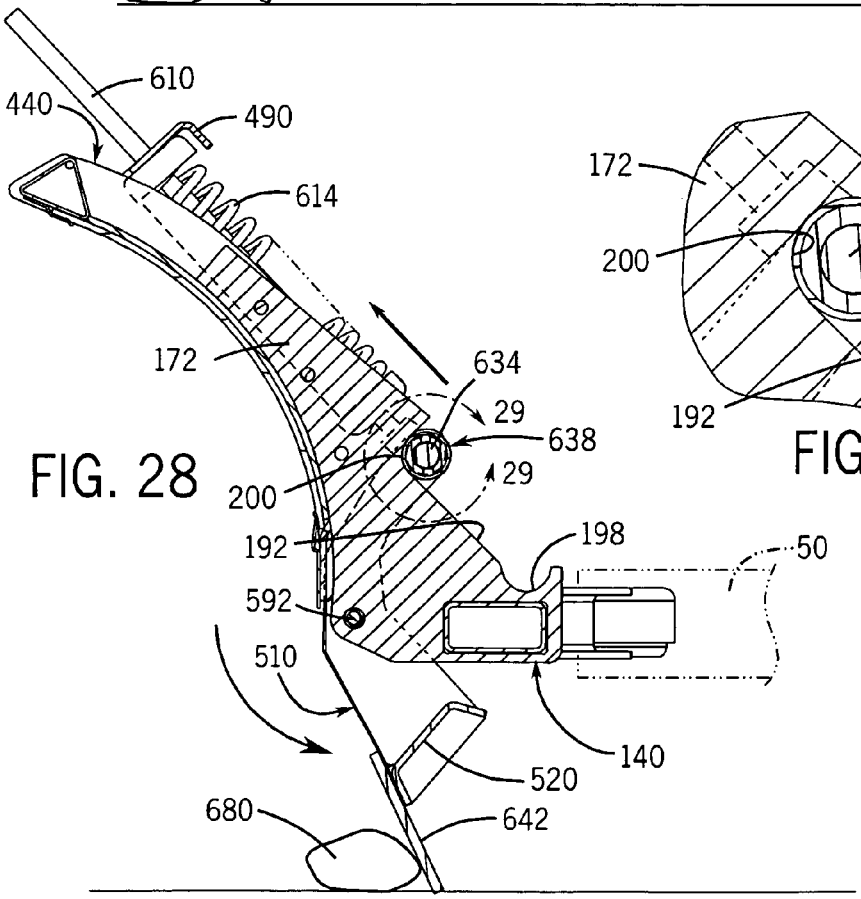
FIG. 28 is a cross-sectional view of the apparatus illustrated in FIGS. 23 and 24, showing the trip edge snow plow blade and the spring assemblies in a second tripped position.
Figure 29:
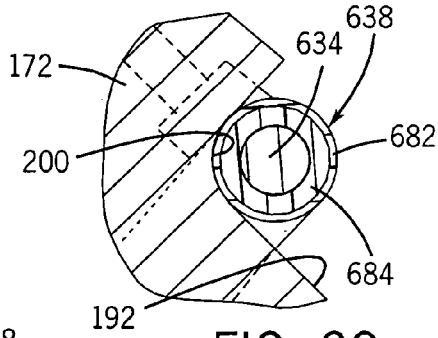
FIG. 29 is an enlarged partial cross-sectional view of the apparatus illustrated in FIGS. 28 and 24, showing a blade trip stop in the second tripped position.
Figure 30:
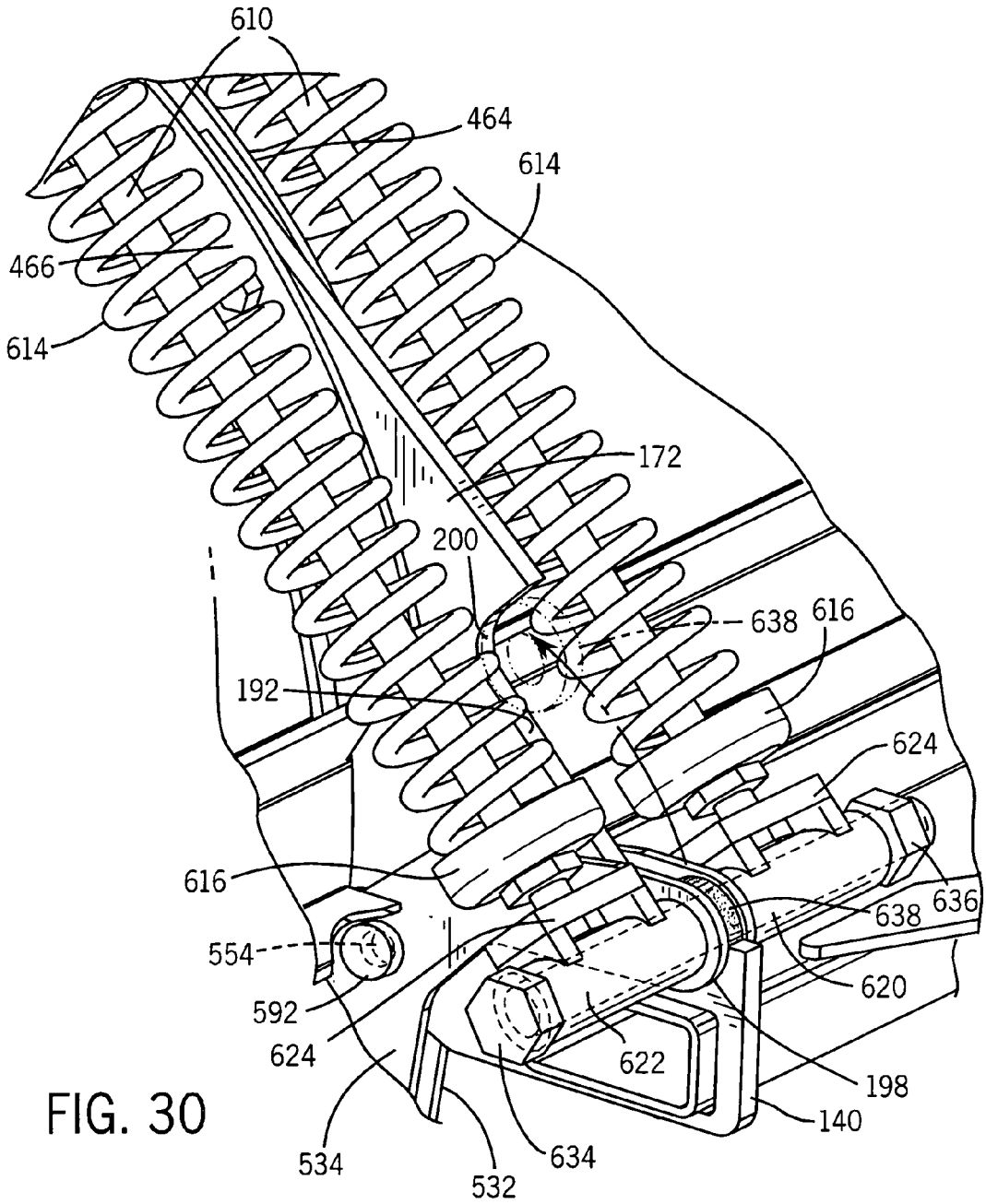
FIG. 30 is an isometric partial view showing the lower portion of the spring assemblies on the left side of the trip edge snow plow blade in the first untripped position, shown from the left side and the rear.
Figures 31, 32:
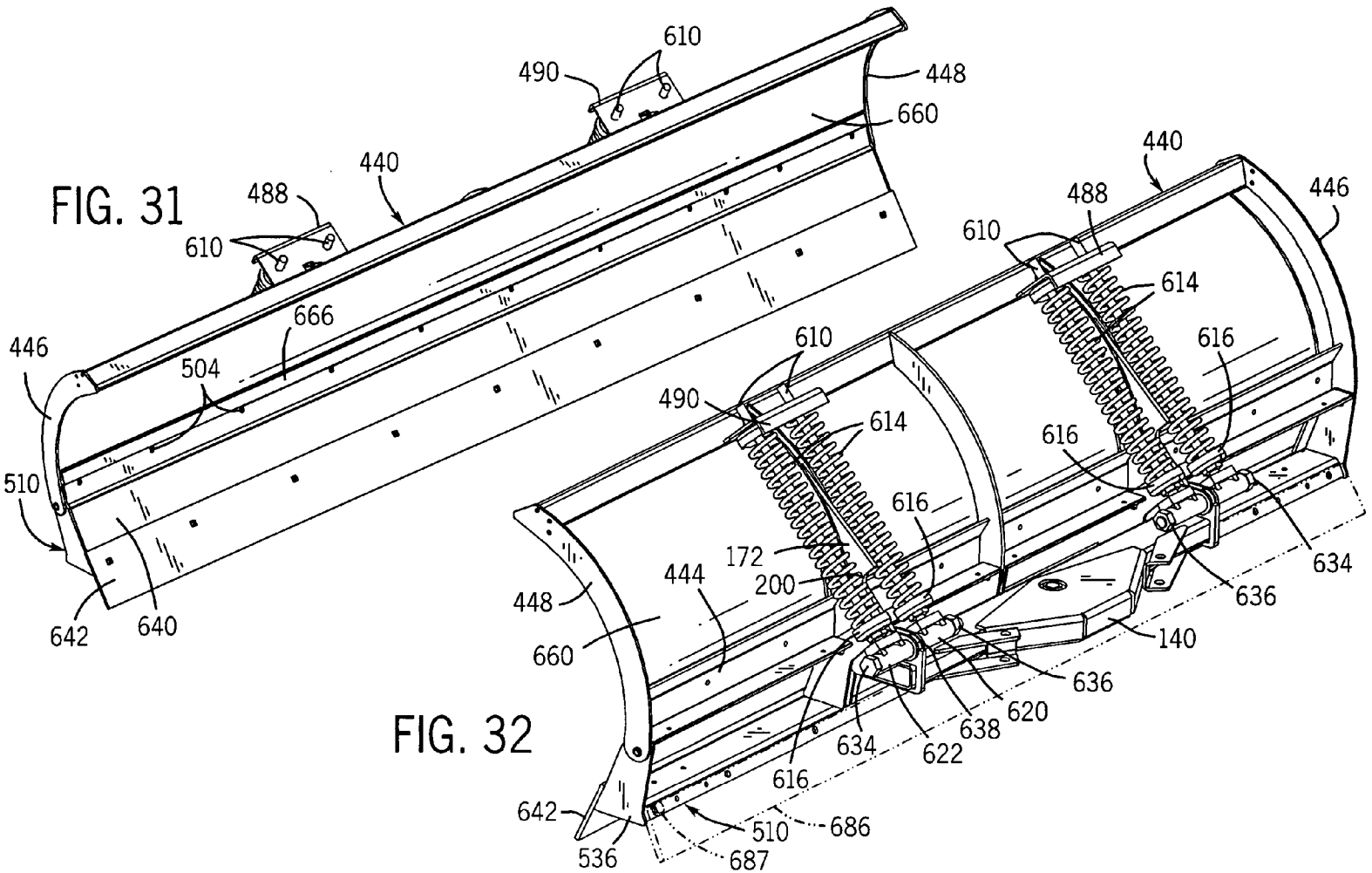
FIG. 31 is an isometric view of the fully assembled snow plow blade of the present invention, shown from the right side and the front.
FIG. 32 is an isometric view of the fully assembled snow plow blade of the present invention shown in FIG. 32, shown from the left side and the rear, showing an optional back blade wearstrip in phantom lines.

The preferred embodiment of the trip edge snow plow blade of the present invention is illustrated in a series of figures, of which FIGS. 3 through 5 and 11 through 17 show components of the trip edge snow plow blade which embodies the present invention. FIGS. 18 through 26 illustrate the assembly of the trip edge snow plow blade embodying the present invention, and FIGS. 27 through 29 illustrate the manner in which the trip edge snow plow blade of the present invention operates. FIGS. 30 through 32 show the assembled trip edge snow plow blade of the present invention.

Figure 33:
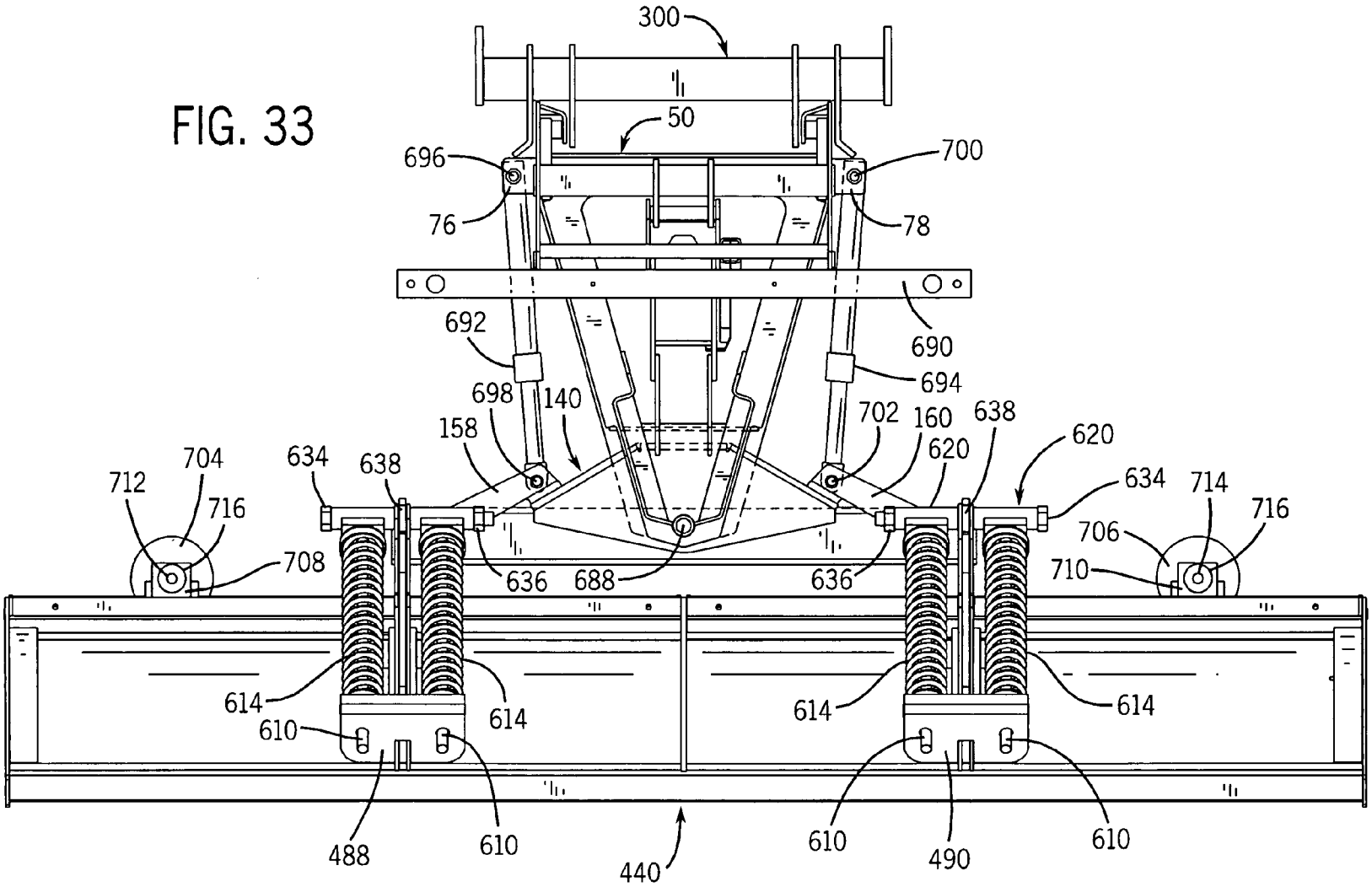
FIG. 33 is a top plan view of the trip edge snow plow blade illustrated in FIGS. 31 and 32 assembled onto the snow plow frame illustrated in FIG. 10, which is shown as mounted on the hitch frame nose piece illustrated in FIG. 7.

FIGS. 1, 2, 6, 8, and 9 are components of a snow plow frame on which the trip edge snow plow blade of the present invention may be mounted. FIG. 7 is a hitch frame nose piece which will be mounted on a truck, and upon which the snow plow frame will be mounted. FIG. 10 illustrates the assembled components of the snow plow frame as well as the mounting of the snow plow frame on the hitch frame nose piece. FIG. 33 shows the assembled trip edge snow plow blade of the present invention mounted onto the snow plow frame.

Figure 1:
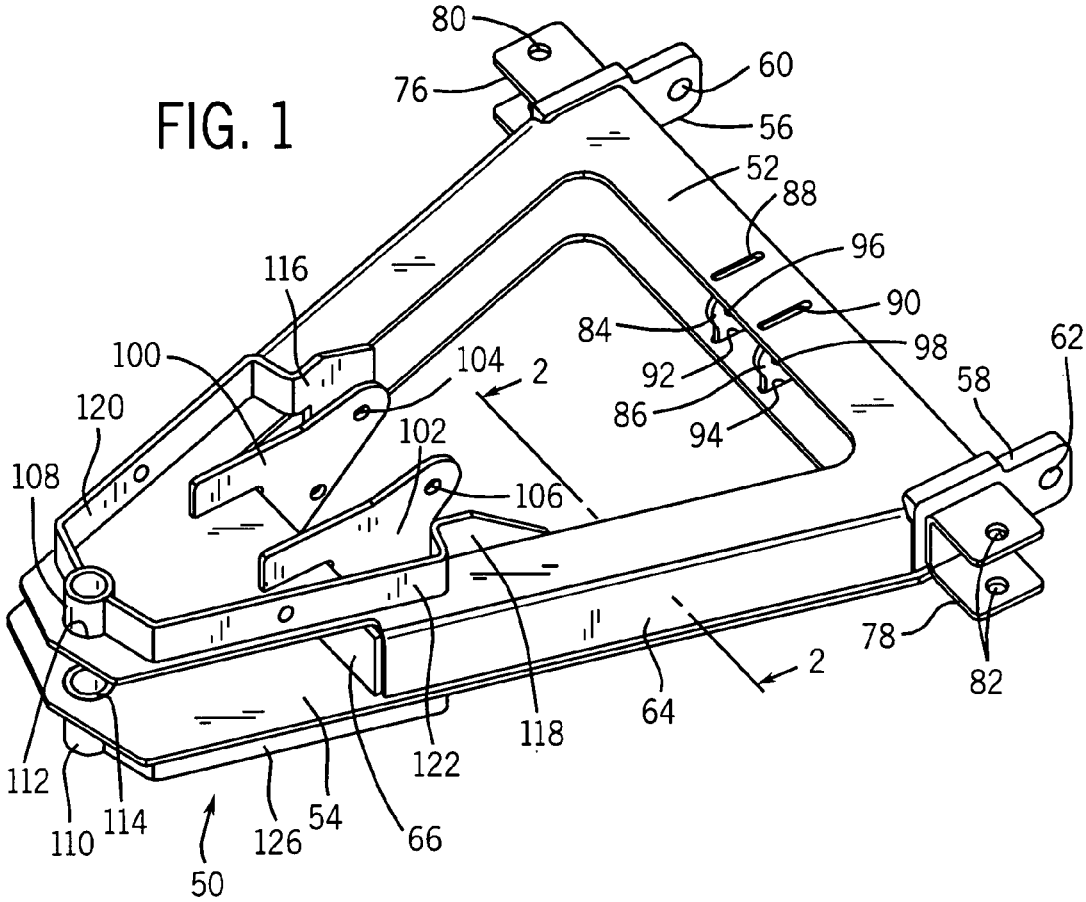
FIG. 1 is a perspective view of a plow A-frame.
Figure 2:
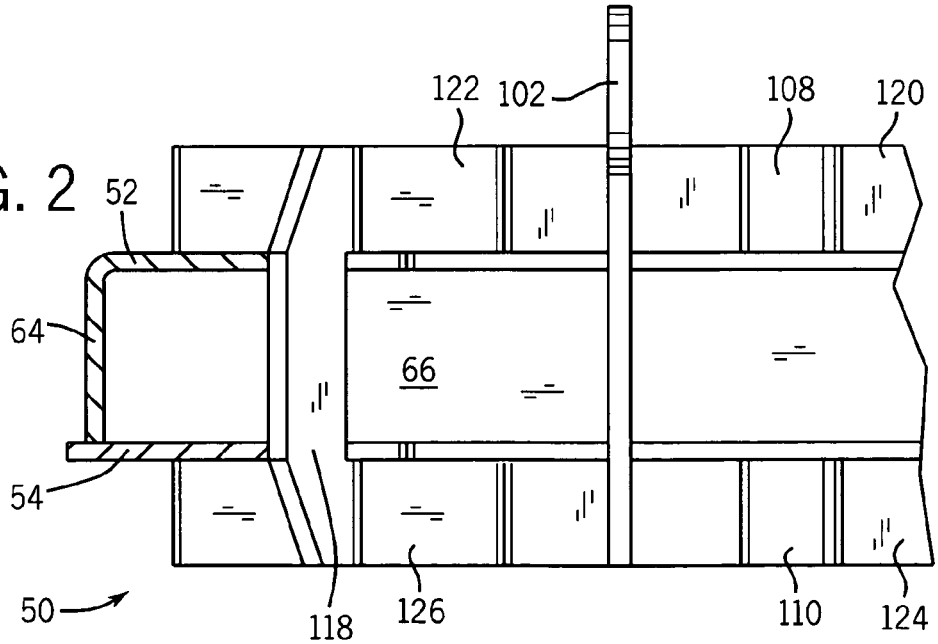
FIG. 2 is a partial cross-sectional view of the plow A-frame illustrated in FIG. 1.

Referring first to FIGS. 1 and 2, a plow A-frame 50 is illustrated. The plow A-frame 50 as illustrated in FIGS. 1 and 2 has its front end shown at the left of FIG. 2 and its rear end shown at the right of FIG. 2, and is symmetric around an axis running from the front to the rear thereof. The plow A-frame 50 tapers from a narrower width at the front thereof to a wider width at the rear thereof.

The basic shape of the plow A-frame 50 is formed by a top plate 52 and a bottom plate 54, which are essentially parallel and are spaced apart from each other. The configurations of the top plate 52 and the bottom plate 54 as viewed from the top (or from the bottom) resemble a portion of the capital letter "A," with the portions of the sides of the "A" above the crossbar of the "A" being absent. There is a large aperture extending through each of the top plate 52 and the bottom plate 54 above the crossbar of the "A," which apertures resemble an isosceles trapezoid. The top plate 52 and the bottom plate 54 are preferably made of steel plate.

Mounted between the sides of the top plate 52 and the bottom plate 54 at the location of the crossbar of the "A" and extending rearwardly so as to resemble abbreviated legs of the "A" below the crossbar are two lugs 56 and 58 made of flat bar stock. The lugs 56 and 58 are also preferably made of steel, and are welded onto the sides of the top plate 52 and the bottom plate 54. The portion of the lug 56 which extends rearwardly from the top plate 52 and the bottom plate 54 has an aperture 60 extending therethrough, and the portion of the lug 58 which extends rearwardly from the top plate 52 and the bottom plate 54 has an aperture 62 extending therethrough.

Portions of three sides of the top plate 52 are bent downwardly at a ninety degree angle to extend to the top of the bottom plate 54. Only one of these sides, a left side 64, is visible in FIGS. 1 and 2. The left side 64 of the top plate 52 extends from just in front of the lug 58, and extends approximately two-thirds of the way toward the front end of the plow A-frame 50. A right side of the top plate 52 (which is the mirror image of the left side 64 of the top plate 52) and a rear side of the top plate 52 extending between the lugs 56 and 58 are also bent downwardly at ninety degree angles to extend to the top of the bottom plate 54. These three sides are all welded to the bottom plate 54 to create a box-like structure. A rectangular plate 66 is located just in front of the isosceles trapezoid-shaped apertures in the top plate 52 and the bottom plate 54, and extends between the sides of the top plate 52 and the bottom plate 54. The rectangular plate 66 is also preferably made of steel, and all four sides of the rectangular plate 66 are welded onto the top plate 52 (including the left side 64 and right side thereof) and the bottom plate 54 to provide the fourth side of the box-like structure.

Extending from the sides of the lugs 56 and 58 are U-shaped swing cylinder mounts 76 and 78, respectively. The swing cylinder mounts 76 and 78 are also preferably made of steel, and are welded onto the lugs 56 and 58, respectively, with the legs of the U's of the swing cylinder mounts 76 and 78 being located on the top and the bottom of the plow A-frame 50. An aperture 80 is located in each leg of the U in the swing cylinder mount 76, and an aperture 82 is similarly located in each leg of the U in the swing cylinder mount 78.

Located between the rear of the top plate 52 at the location of the crossbar of the "A" and the rear of the bottom plate 54 at the location of the crossbar of the "A" are two lift cylinder mounts 84 and 86. The cylinder mounts 84 and 86 are parallel both to each other and to the plane which divides the plow A-frame 50 into left and right sides thereof. The cylinder mounts 84 and 86 each extend from slots 88 and 90, respectively, located in the crossbar of the "A" of the top plate 52 and slots 92 and 94, respectively, located in the crossbar of the "A" of the bottom plate 54. The cylinder mounts 84 and 86 are also preferably made of steel, and their ends are welded into the slots 88 and 90, respectively, in the top plate 52 and the slots 92 and 94, respectively, in the bottom plate 54. The cylinder mounts 84 and 86 each have an aperture 96 or 98, respectively, located therein which apertures 96 and 98 are coaxial.

Located at the top of the aperture in the "A" in the plow A-frame 50 are two parallel, spaced-apart, pivot mount plates 100 and 102. The pivot mount plates 100 and 102 are also preferably made of steel, and are welded onto the rectangular plate 66, the portion of the top plate 52 adjacent thereto, and the portion of the bottom plate 54 adjacent thereto. The pivot mount plates 100 and 102 are mounted on opposite sides of the centerline of the plow A-frame 50, and extend rearwardly and upwardly from the rectangular plate 66, and are beneath a portion of the bottom plate 54. Located near the rearmost and uppermost ends of the pivot mount plates 100 and 102 are apertures 104 and 106, respectively, which are coaxial.

Mounted near the front of the plow A-frame 50 are two hollow cylindrical swing frame pivots 108 and 110. The swing frame pivots 108 and 110 are centrally mounted near the front end of the plow A-frame 50 in apertures 112 and 114, respectively, which are located in the top plate 52 and the bottom plate 54, respectively. The swing frame pivots 108 and 110 are also preferably made of steel, and are welded into the apertures 112 and 114, respectively. The swing frame pivots 108 and 110 are coaxial and are orthogonal to the top plate 52 and the bottom plate 54.

Located on the inside of each of the legs of the "A" of the plow A-frame 50 near to the top of the "A" are two support sides 116 and 118. The support sides 116 and 118 extend perhaps one-fourth of the way from the top of the opening of the "A" toward the crossbar of the "A." The ends of the support sides 116 and 118 oriented closest to the crossbar of the "A" extend between the top side of the top plate 52 and the bottom side of the bottom plate 54, and the support sides 116 and 118 increase in height above the top plate 52 and below the bottom plate 54 as the support sides 116 and 118 extend towards the front of the plow A-frame 50. The support sides 116 and 118 are preferably made of steel, and are welded to the top plate 52, the bottom plate 54, and the rectangular plate 66.

Four U-shaped ribs 120, 122, 124, and 126 extend between the support sides 116 and 118 and the swing frame pivots 108 and 110. The bases of the "U" of each of the U-shaped ribs 120, 122, 124, and 126 are much wider than the legs of the "U" are tall. The U-shaped ribs 120 and 122 are mounted on top of the top plate 52, and the bases of the "U's" of the U-shaped ribs 120 and 122 are located close adjacent the right and left sides, respectively, of the top plate 52. The U-shaped rib 124 and 126 are mounted on the bottom of the bottom plate 54, and the bases of the "U's" of the U-shaped ribs 124 and 126 are located close adjacent the right and left sides, respectively, of the bottom plate 54. In the preferred embodiment, the U-shaped rib 120, the support side 116, and the U-shaped rib 124 are manufactured as a single component, and likewise the U-shaped rib 122, the support side 118, and the U-shaped rib 126 are also manufactured as a single component.

One leg of the U-shaped rib 120 extends between the base of the "U" and the support side 116, and the other leg of the U-shaped rib 120 extends between the base of the "U" and the swing frame pivot 108. One leg of the U-shaped rib 122 extends between the base of the "U" and the support side 118, and the other leg of the U-shaped rib 122 extends between the base of the "U" and the swing frame pivot 108. One leg of the U-shaped rib 124 extends between the base of the "U" and the support side 116, and the other leg of the U-shaped rib 124 extends between the base of the "U" and the swing frame pivot 110. One leg of the U-shaped rib 126 extends between the base of the "U" and the support side 118, and the other leg of the U-shaped rib 126 extends between the base of the "U" and the swing frame pivot 110.

The U-shaped ribs 120, 122, 124, and 126 are preferably made of steel, and the U-shaped ribs 120 and 122 are welded onto the top plate 52, while the U-shaped ribs 124 and 126 are welded onto the bottom of the bottom plate 54. As mentioned above, the U-shaped ribs 120 and 124 may be made integrally with the support side 116, while the U-shaped rib 122 and 126 may be made integrally with the support side 118. The swing frame pivots 108 and 110 define an axis upon which a swing frame which will be described below in conjunction with FIGS. 3 through 5 will be mounted, and the area between the top plate 52 and the bottom plate 54 and in front of the rectangular plate 66 is the area in which the swing frame will be mounted.

Figure 3:
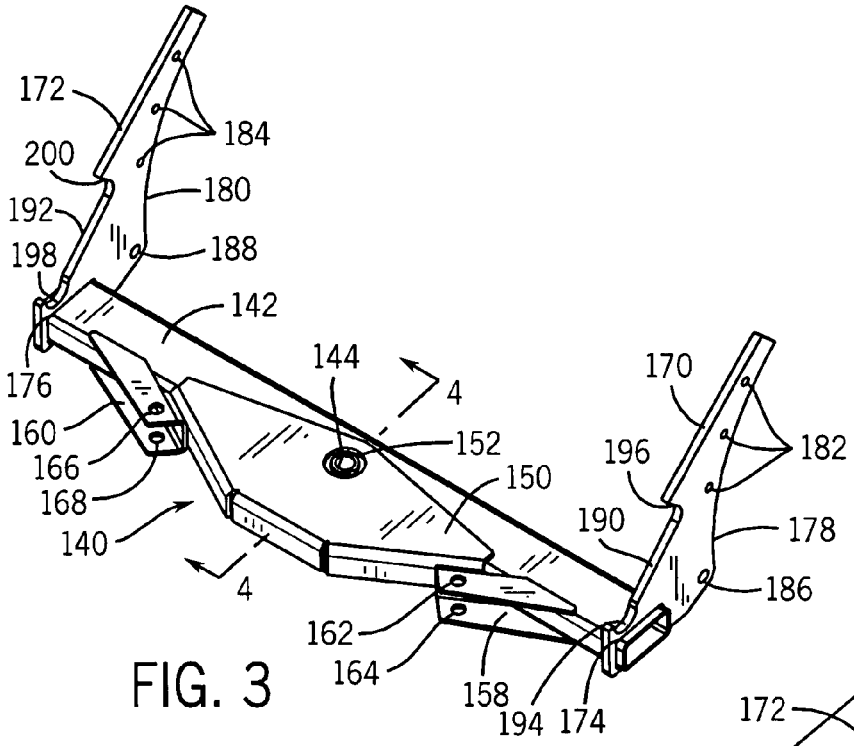
FIG. 3 is an isometric view of a plow swing frame which will be pivotally mounted on the front end of the plow A-frame illustrated in FIGS. 1 and 2 and which will support a plow blade therefrom.
Figure 4:
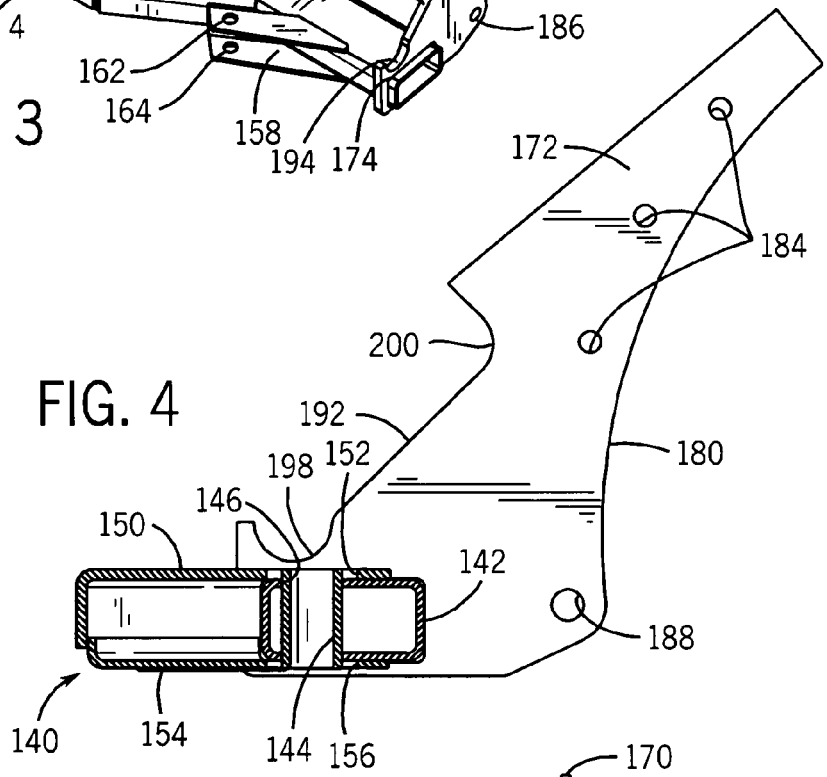
FIG. 4 is a cross-sectional view of the plow swing frame illustrated in FIG. 3.
Figure 5:
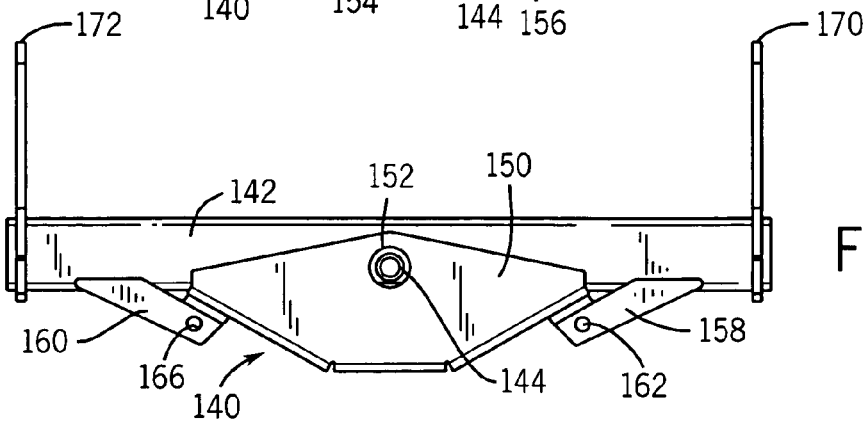
FIG. 5 is a top plan view of the plow swing frame illustrated in FIGS. 3 and 4.

Referring next to FIGS. 3 through 5, a swing frame 140 is illustrated which will be mounted as described above on the plow A-frame 50 (illustrated in FIGS. 1 and 2). The swing frame 140 is based upon a rectangular swing frame tube 142 having a hollow cylindrical pivot tube 144 extending through the thinner cross section thereof at the midpoint of the length of the rectangular swing frame tube 142. The rectangular swing frame tube 142 has an aperture 146 located in the top side thereof and another aperture 148 located in the bottom side thereof. The apertures are closer to the rear side of the rectangular swing frame tube 142 than they are to the front side thereof. Both the rectangular swing frame tube 142 and the pivot tube 144 are preferably made of steel, and the pivot tube 144 is welded to the rectangular swing frame tube 142. The pivot tube 144 extends slightly above and below the top and bottom, respectively, of the rectangular swing frame tube 142.

A guide/stop plate 150 is located on top of and extends rearwardly from the top of the rectangular swing frame tube 142. The guide/stop plate 150 has an aperture 152 located therein which surrounds the top end of the pivot tube 144. The top surface of the guide/stop plate 150 has a five-sided configuration, with two leading sides respectively extending from a location in front of the pivot tube 144 laterally left and right and rearwardly to the trailing edge of the rectangular swing frame tube 142. The width of the guide/stop plate 150 is perhaps half of the length of the rectangular swing frame tube 142, and the guide plate 150 is mounted at the lateral midpoint of the rectangular swing frame tube 142.

The top surface of the guide/stop plate 150 has a rear side that is parallel to and located rearwardly away from the rectangular swing frame tube 142, with the remaining two trailing sides of the top surface of the rectangular swing frame tube 142 extending between the left-most and right-most extents of the two leading sides and the left-most and right-most extents of the rear side of the top surface of the rectangular swing frame tube 142. The trailing sides and the rear sides of the guide/stop plate 150 extend downwardly to locations just above a plane coincident with the bottom side of the rectangular swing frame tube 142. The guide/stop plate 150 is preferably also made of steel, and is welded onto the rectangular swing frame tube 142.

A bottom guide/stop plate 154 is located on the bottom of and extends rearwardly from the bottom of the rectangular swing frame tube 142. The bottom guide/stop plate 154 has an aperture 156 located therein which surrounds the bottom end of the pivot tube 144. The bottom surface of the bottom guide/stop plate 154 has a five-sided configuration with leading edges which have the same configuration as the leading edges of the guide/stop plate 150.

The bottom guide/stop plate 154 has a rear edge and trailing edges which have a similar configuration to that of the rear edge and trailing edges of the guide/stop plate 150. The rear edge and the trailing edges of the bottom guide/stop plate 154 extend upwardly, with the upward extensions of the bottom guide/stop plate 154 being located just inside the downward extensions of the rear edge and trailing edges of the guide/stop plate 150. The bottom guide/stop plate 154 is preferably also made of steel, and is welded onto the rectangular swing frame tube 142 and the rear edge and trailing edges of the guide/stop plate 150.

Two swing cylinder brackets 158 and 160 are mounted onto the rectangular swing frame tube 142 at positions behind and laterally outboard of the left-most and right-most extents of the trailing edges of the guide/stop plate 150. The swing cylinder brackets 158 and 160 are made of U-shaped material, with the portions of the swing cylinder brackets 158 and 160 which are located over and under the rectangular swing frame tube 142 being cut away to admit the rectangular swing frame tube 142 in the cutaway portions. The swing cylinder brackets 158 and 160 are preferably made of steel, and are welded onto the rectangular swing frame tube 142 and the guide/stop plate 150.

Located in the top side of the swing cylinder bracket 158 near the rearmost corner thereof is an aperture 162, and located in the bottom side of the swing cylinder bracket 158 near the rearmost corner thereof is an aperture 164. Located in the top side of the swing cylinder bracket 160 near the rearmost corner thereof is an aperture 166, and located in the bottom side of the swing cylinder bracket 160 near the rearmost corner thereof is an aperture 168. The apertures 162 and 164 are coaxial, and the apertures 166 and 168 are coaxial.

Two blade mounting brackets 170 and 172 are mounted on the rectangular swing frame tube 142 at the opposite (left and right) ends thereof. The blade mounting brackets 170 and 172 have rectangular apertures 174 and 176, respectively, extending therethrough to receive therein the rectangular swing frame tube 142. The blade mounting bracket 170 is mounted at the end of the rectangular swing frame tube 142 which will be on the right when the swing frame 140 is mounted on the plow A-frame 50 (illustrated in FIGS. 1 and 2), and the blade mounting bracket 172 is mounted at the end of the rectangular swing frame tube 142 which will be on the left when the swing frame 140 is mounted on the plow A-frame 50. The blade mounting brackets 170 and 172 are preferably also made of steel, and are welded onto the rectangular swing frame tube 142.

It should be noted that the blade mounting brackets 170 and 172 are identical in construction, with each extending upwardly and forwardly in front of the rectangular swing frame tube 142 (as best shown in FIG. 3). Located at the front of the blade mounting brackets 170 and 172 are curved segments 178 and 180, respectively, which will abut the mounting apparatus on the rear of the trip edge snow plow blade of the present invention (illustrated below in FIGS. 11 and 12).

Located along the length of the curved segment 178 in the blade mounting bracket 170 are three blade mounting apertures 182, and located along the length of the curved segment 180 in the blade mounting bracket 172 are three blade mounting apertures 184. Located adjacent the lowermost portion of the curved segment 178 in the blade mounting bracket 170 is an aperture 186, and located adjacent the lowermost portion of the curved segment 180 in the blade mounting bracket 172 is an aperture 188. The apertures 186 and 188 will be used to pivotally mount the snow plow trip blade (illustrated below in FIGS. 15 and 16).

Located in the rearmost edge of the blade mounting bracket 170 and extending from just above the rectangular swing frame tube 142 to a position opposite the lowest of the blade mounting apertures 182 is a long notch 190. Similarly, located in the rearmost edge of the blade mounting bracket 172 and extending from just above the rectangular swing frame tube 142 to a position opposite the lowest of the blade mounting apertures 184 is a long notch 192. The notch 190 in the blade mounting bracket 170 has a curved lower stop 194 and a curved upper stop 196, and the notch 192 in the blade mounting bracket 170 has a curved lower stop 198 and a curved upper stop 200. The curved lower stops 194 and 198 and the curved upper stops 196 and 200 will be used to limit the movement of the snow plow trip blade (as illustrated below in FIGS. 27 through 29).

Figure 6:
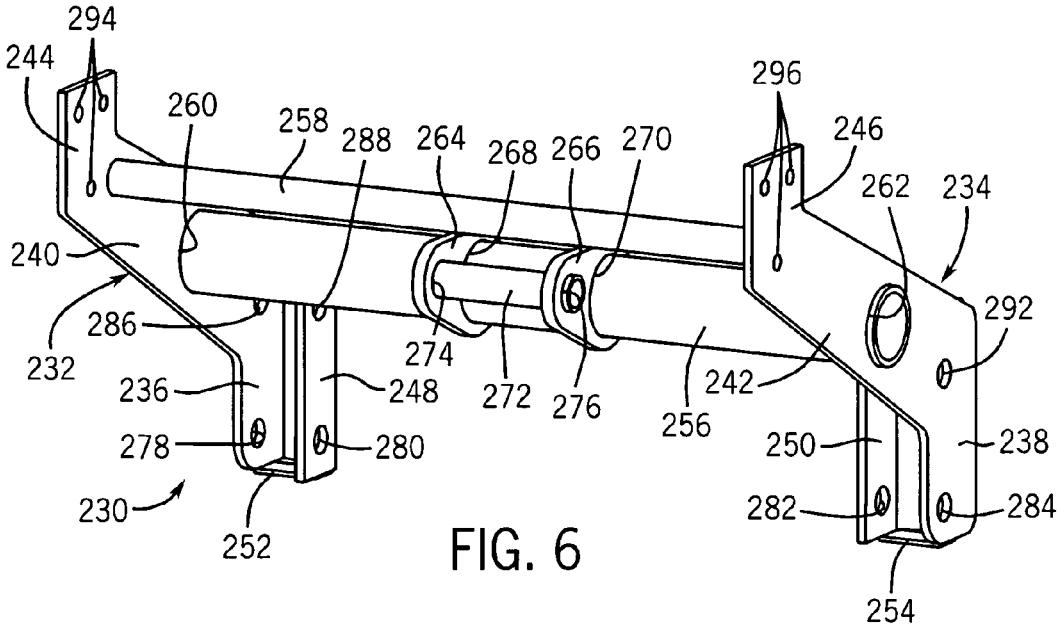
FIG. 6 is a perspective view of a pivoting lift bar which will be pivotally mounted at the rear end of the plow A-frame illustrated in FIGS. 1 and 2.
Figure 7:
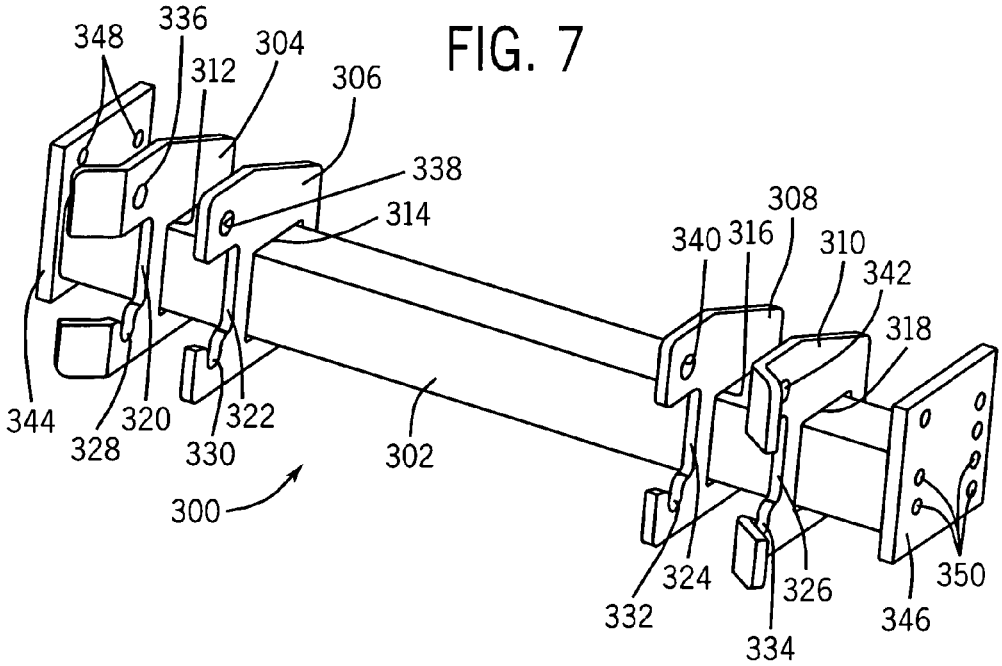
FIG. 7 is a perspective view of a hitch frame nose piece which will be mounted on a truck under the front bumper thereof.

Referring next to FIG. 6, a lift bar 230 is illustrated which forms part of the hitch mechanism of the snow plow. The lift bar 230 has two lift bar support members 232 and 234, which are located on the right and left sides, respectively, of the lift bar 230. Each of the lift bar support members 232 and 234 has a configuration consisting of three segments: rear mounting supports 236 and 238, respectively, which extend upward vertically; central support arms 240 and 242, respectively, which extend forwardly and upwardly from the top of the rear mounting supports 236 and 238, respectively; and front light bar supports 244 and 246, respectively, which extend upwardly from the forwardmost and upwardmost ends of the central support arms 240 and 242, respectively. The lift bar support members 232 and 234 are preferably made of steel plate.

Extending inwardly from the rear sides of rear mounting supports 236 and 238 are segments of angled stock 248 and 250, respectively. It should be noted that the angle defined by each of the segments of angled stock 248 and 250 is less than ninety degrees, as, for example, approximately seventy degrees. The angled stock segments 248 and 250 are also preferably made of steel, and are welded onto rear mounting supports 236 and 238, respectively, so that the rear mounting supports 236 and 238 and the angled stock segments 248 and 250 together form vertically-oriented channels which are essentially U-shaped. Referring for the moment to FIG. 1 in addition to FIG. 6, the space between the rear mounting support 236 and the angled stock segment 248 of the lift bar 230 is designed to admit the lug 56 of the plow A-frame 50 with space between the lug 56 and the inside of the angled stock segment 248, and similarly the space between the angled stock segment 250, and the rear mounting support 238 of the lift bar 230 is designed to admit the lug 58 of the plow A-frame 50 with space between the lug 58 and the inside of the angled stock segment 250.

Referring again solely to FIG. 6, a rectangular reinforcing segment 252 (preferably also made of steel) is located at the bottom of the U-shaped channel formed by the rear mounting support 236 and the angled stock segment 248, and is welded to the bottoms of the rear mounting support 236 and the angled stock segment 248. Similarly, a rectangular reinforcing segment 254 (preferably also made of steel) is located at the bottom of the U-shaped channel formed by the rear mounting support 238 and the angled stock segment 250, and is welded to the bottoms of the rear mounting support 238 and the angled stock segment 250.

Not illustrated in the figures but used to reinforce the construction of the lift bar 230 are two additional rectangular reinforcing segments which are respectively located above the reinforcing segments 252 and 254. On the right side of the lift bar 230, the first of these additional reinforcing segments (preferably also made of steel) is located near the top of the U-shaped channel formed by the rear mounting support 236 and the angled stock segment 248, and is welded to the tops of the rear mounting support 236 and the angled stock segment 248. Similarly, the other of these reinforcing segments (preferably also made of steel) is located at near the top of the U-shaped channel formed by the rear mounting support 238 and the angled stock segment 250, and is welded to the tops of the rear mounting support 238 and the angled stock segment 250.

Extending between the lift bar support members 232 and 234 are a larger diameter hollow round upper pin support tube 256 and a smaller diameter round light bar brace 258. The upper pin support tube 256 and the light bar brace 258 are both also preferably made of steel. One end of the upper pin support tube 256 extends through an aperture 260 located in an intermediate position in the central support arm 240 of the lift bar support member 232, and the other end of the upper pin support tube 256 extends through an aperture 262 located in an intermediate position in the central support arm 242 of the lift bar support member 234. The ends of the upper pin support tube 256 are welded onto the central support arms 240 and 242. One end of the light bar brace 258 is welded onto the lift bar support member 232 at the intersection of the central support arm 240 and the light bar support 244, and the other end of the light bar brace 258 is welded onto the lift bar support member 234 at the intersection of the central support arm 242 and the light bar support 246.

Two upper pin hanger plates 264 and 266 are mounted on the upper pin support tube 256 in spaced-apart fashion near the middle of the upper pin support tube 256. The upper pin hanger plates 264 and 266 have apertures 268 and 270, respectively, extending therethrough near one end thereof, and the upper pin support tube 256 extends through these apertures 268 and 270. The upper pin hanger plates 264 and 266 are both also preferably made of steel, and are welded onto the upper pin support tube 256 in a manner whereby they are projecting forwardly. A tubular upper pin 272 extends through apertures 274 and 276 in the upper pin hanger plates 264 and 266, respectively, near the other end thereof. The upper pin 272 is also preferably made of steel, and is welded onto the upper pin hanger plates 264 and 266.

Located in the rear mounting support 236, the angled stock segment 248, the angled stock segment 250, and the rear mounting support 238 near the bottoms thereof are apertures 278, 280, 282, and 284, respectively, which are aligned with each other and which together define a pivot axis about which the lift bar 230 will pivot when it is mounted onto the plow A-frame 50 (Illustrated in FIG. 1). Located in the rear mounting support 236, the angled stock segment 248, the angled stock segment 250, and the rear mounting support 238 nearer the tops thereof than the bottoms thereof are apertures 286, 288, 290 (not shown in FIG. 6), and 292, which are aligned with each other.

The apertures 286 and 288 define a first location into which a retaining pin (not shown in FIG. 6) will be placed to mount the snow plow onto a truck, and the apertures 290 and 292 define a second location into which another retaining pin (not shown in FIG. 6) will be placed to mount the snow plow onto the truck. Located in the light bar support 244 are three apertures 294, and located in the light bar support 246 are three apertures 296. The apertures 294 and 296 will be used to mount a light bar (not illustrated in FIG. 6) onto the lift bar 230.

Referring now to FIG. 7, a hitch frame nose piece 300 which will be mounted onto a truck under the front bumper (not illustrated in FIG. 7) thereof is illustrated. The hitch frame nose piece 300 has a square hitch frame tube 302 which is horizontally oriented. Four hitch brackets 304, 306, 308, and 310 are mounted on the square hitch frame tube 302 in spaced-apart pairs located nearer the ends of the square hitch frame tube 302 than the center thereof. The hitch brackets 304, 306, 308, and 310 have square apertures 312, 314, 316, and 318, respectively, extending therethrough to receive therein the square hitch frame tube 302. Both the square hitch frame tube 302 and the hitch brackets 304, 306, 308, and 310 are preferably made of steel, and the hitch brackets 304, 306, 308, and 310 are welded onto the square hitch frame tube 302.

Referring for the moment to FIG. 6 in addition to FIG. 7, the space between the hitch bracket 304 and the hitch bracket 306 of the hitch frame nose piece 300 is designed to admit the rear mounting support 236 and the angled stock segment 248 of the lift bar 230, and similarly the space between the hitch bracket 308 and the hitch bracket 310 of the hitch frame nose piece 300 is designed to admit the angled stock segment 250 and the rear mounting support 238 of the lift bar 230. The hitch brackets 304, 306, 308, and 310 have rectangular notches 320, 322, 324, and 326, respectively, cut into the front sides thereof.

Located in the hitch brackets 304, 306, 308, and 310 in the bottoms of the rectangular notches 320, 322, 324, and 326, respectively, are slots 328, 330, 332, and 334, respectively. The slots 328, 330, 332, and 334 have rounded bottoms, and are axially aligned. Also located in the hitch brackets 304, 306, 308, and 310 above the tops of the rectangular notches 320, 322, 324, and 326, respectively, are apertures 336, 338, 340, and 342, respectively. The apertures 336, 338, 340, and 342 are also axially aligned.

Unlike the hitch brackets 306 and 308 which are flat, the hitch brackets 304 and 310 have their forward-most portions flanged outwardly to act as guides to direct the lift bar 230 (illustrated in FIG. 6) into engagement with the hitch frame nose piece 300. Thus, the portions of the hitch brackets 304 and 310 at the front of the rectangular notches 320 and 326, respectively, extend outwardly, both on the top of the rectangular notches 320 and 326 and on the bottom of the rectangular notches 320 and 326. It should be noted that, if desired, the hitch brackets 304 and 310 may also be flat. The ramifications of having them flat instead of flanged will eliminate the utility of the right and left sides of the lift bar 230.

The respective ends of the square hitch frame tube 302 are mounted onto mounting plates 344 and 346. The mounting plates 344 and 346 are also preferably made of steel, and the ends of the square hitch frame tube 302 are welded onto the mounting plates 344 and 346. Located in the mounting plates 344 and 346 are a plurality of apertures 348 and 350, respectively, which will be used to mount the hitch frame nose piece 300 onto the frame of a truck (not shown in FIG. 7) using mounting brackets (not shown in FIG. 7) in a manner which is conventional.

Figure 8:
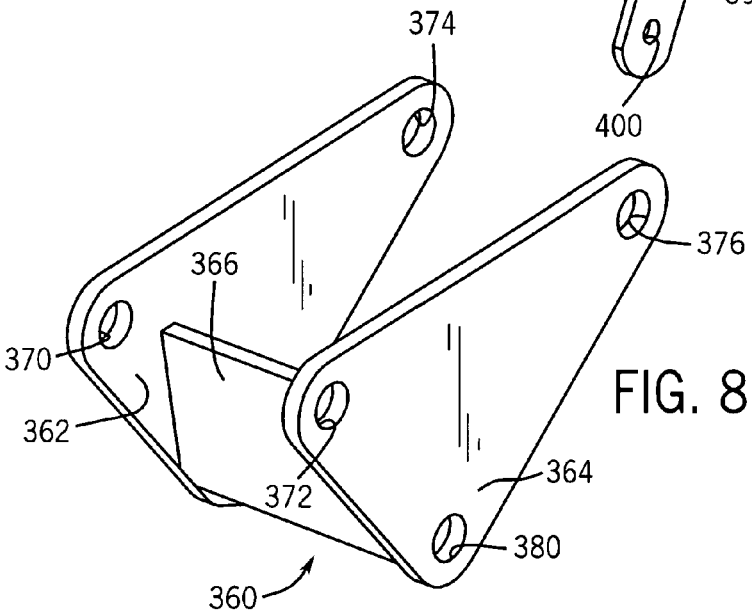
FIG. 8 is a perspective view of a bellcrank which is used to operate the pivoting lift bar illustrated in FIG. 6.

Referring next to FIG. 8, a bellcrank 360 is illustrated. The bellcrank 360 has parallel, spaced apart triangular pivot plates 362 and 364. One of the sides of the triangle is shorter than the other two in each of the pivot plates 362 and 364. A gusset plate 366 is mounted between the pivot plates 362 and 364 with one side thereof near the shortest side of the triangle to support the pivot plates 362 and 364 in their spaced-apart configuration. In the preferred embodiment, both the pivot plates 362 and 364 and the gusset plate 366 are made of steel, and are welded together.

The pivot plates 362 and 364 have apertures 370 and 372, respectively, located therein near a first corner of the triangle which will be used to mount the bellcrank 360 for pivotal movement from the apertures 104 and 106 of the pivot mount plates 100 and 102, respectively (illustrated in FIG. 1). The pivot plates 362 and 364 have apertures 374 and 376, respectively, located therein near a second corner of the triangle which will be connected via the element to be discussed in FIG. 9 below to drive the upper pin 272 of the lift bar 230 (illustrated in FIG. 6). The pivot plates 362 and 364 have apertures 378 and 380, respectively, located therein near the third corner of the triangle will be connected to a hydraulic cylinder (not shown in FIG. 8). The short side of the triangle is between the first and third corners of the triangle. The side of the gusset plate 366 adjacent this short side will act as a lift stop to limit pivotal movement of the gusset plate 366 when this side of the gusset plate 366 contacts the pivot mount plates 100 and 102 (illustrated in FIG. 1).

Figure 9:
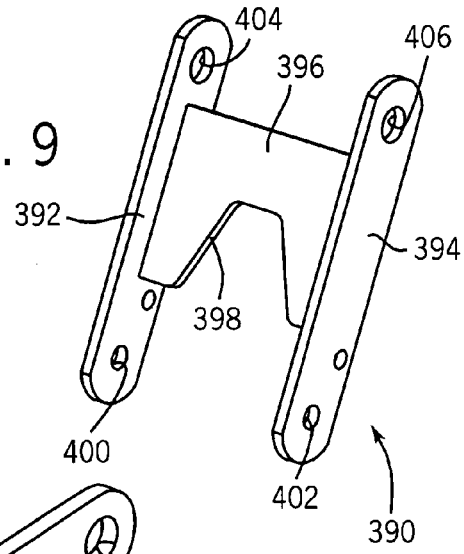
FIG. 9 is a perspective view of a lift link which connects the bellcrank illustrated in FIG. 8 to the pivoting lift bar illustrated in FIG. 6.
Figure 10:
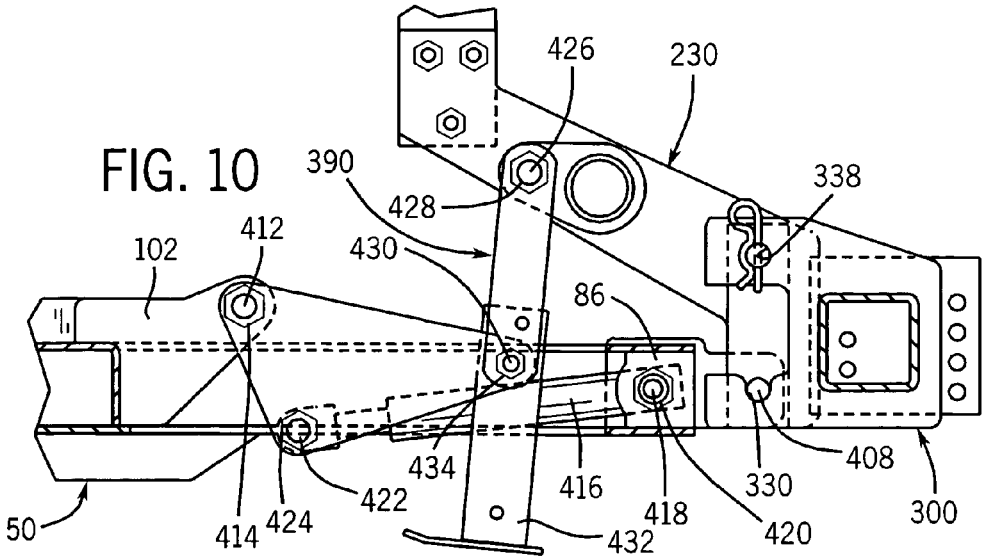
FIG. 10 is a cutaway view of the various components of the snow plow frame assembled together, showing the hydraulic cylinder used to pivot the lift bar.

Referring now to FIG. 9, a lift link 390 is illustrated. The lift link 390 has parallel, spaced apart arms 392 and 394. A gusset plate 396 is mounted between the arms 392 and 394 in their spaced-apart configuration. The side of the gusset plate 396 which is oriented toward one end of the arms 392 and 394 has a notch 398 cut therein. In the preferred embodiment, both the arms 392 and 394 and the gusset plate 396 are made of steel, and are welded together. The one end of the arms 392 and 394 have apertures 400 and 402, respectively, located therein, and the other ends of arms 392 and 394 have apertures 404 and 406, respectively, located therein.

Referring next to FIG. 10, the linkage used to attach the plow A-frame to the hitch frame nose piece 300 is illustrated. The components which are linked together are the plow A-frame 50, the lift bar 230, the bellcrank 360, and the lift link 390. Accordingly, reference may also be had to FIGS. 1, 6, 8, and 9 in the following description of the interconnection of these components. The lift bar 230 is pivotally mounted on the plow A-frame 50 using two pins 408 and 410 (the pin 410 is not shown in FIG. 10) which are each of a length longer than distance between the opposite-facing sides of the pairs of the hitch brackets 304 and 306, or 308 and 310 (illustrated in FIG. 7). The pins 408 and 410 are preferably made of steel.

In the preferred embodiment, a hollow cylindrical collar having a setscrew may be used with the pin 410 as a spacer. A similar collar which a setscrew may be used with the pin 408 as a spacer. The collar will be located intermediate the lug 58 on the plow A-frame 50 and the angled stock segment 250 on the lift bar 230. The setscrew on the collar may be used to lock the collar in place on the pin 410. The other collar will be located intermediate the lug 56 on the plow A-frame 50 and the angled stock segment 248 on the lift bar 230, with a setscrew in that collar being used to lock that collar in place on the pin 408.

The pin 408 will thus extend sequentially through the aperture 278 in the rear mounting support 236 of the lift bar 230, the aperture 60 in the lug 56 of the plow A-frame 50, the collar, and the aperture 280 in the rear mounting support 238 of the lift bar 230. The pin 408 will be retained in place by the setscrew on the collar, which will contact the pin 408 when it is screwed into the collar. Approximately equal lengths of the pin 408 extend outwardly beyond the rear mounting support 236 and the angled stock segment 248 at each end of the pin 408. Alternately, the pin 408 may be welded in place on the rear mounting support 236 and the angled stock segment 248 of the lift bar 230, or C-clips (not shown herein) could be installed in annular groves (not shown herein) in the pin 408 at locations which correspond to the ends of the collar.

The pin 410 will thus extend sequentially through the aperture 282 in the angled stock segment 250 of the lift bar 230, the collar, the aperture 62 in the lug 58 of the plow A-frame 50, and the aperture 284 in the rear mounting support 238 of the lift bar 230. The pin 410 will be retained in place by the setscrew on the collar, which will contact the pin 410 when it is screwed into the collar. Equal lengths of the pin 410 extend outwardly beyond the angled stock segment 250 and the rear mounting support 238 at each end of the pin 410. Alternately, the pin 410 may be welded in place on the angled stock segment 250 and the rear mounting support 238 of the lift bar 230, or C-clips (not shown herein) could be installed in annular groves (not shown herein) in the pin 410 at locations which correspond to the ends of the collar 409.

It will thus be appreciated by those skilled in the art that the lift bar 230 is pivotally mounted onto the plow A-frame 50 using the pins 408 and 410. When the snow plow is mounted onto a vehicle using the hitch frame nose piece 300, the ends of the pins 408 and 410 will be received in the pairs of slots 328 and 330, and 332 and 334 in the hitch frame nose piece 300 (illustrated in FIG. 7). Thus, the pins 408 and 410 function both to pivotally mount the lift bar 230 onto the plow A-frame 50, and to help to mount the snow plow onto the hitch frame nose piece 300.

The bellcrank 360 is pivotally mounted on the plow A-frame 50 using two bolts 412 and two nuts 414. The pivot plates 362 and 364 of the bellcrank 360 will fit outside of the pivot mount plates 100 and 102, respectively. One of the bolts 412 will extend through the aperture 104 in the pivot mount plate 100 of the plow A-frame 50 and the aperture 370 in the pivot plate 362 of the bellcrank 360, and one of the nuts 414 will be mounted on that bolt 412 to retain it in place. The other one of the bolts 412 will extend through the aperture 106 in the pivot mount plate 102 of the plow A-frame 50 and the aperture 372 in the pivot plate 364 of the bellcrank 360, and the other one of the nuts 414 will be mounted on that bolt 412 to retain it in place.

The bolts 412 allow the bellcrank 360 to pivot on the plow A-frame 50. A spacer and two washers (not shown) may be used with each of the bolts 412, the spacer going through the apertures in the parts being pivotally joined and being longer than the combined thickness of the apertures in the parts, and a washer being located on either end of the spacer to facilitate free rotation of parts, here movement of the bellcrank 360 with reference to the plow A-frame 50. It will be understood by those skilled in the art that a spacer and two washers will preferably be used at other points of relative movement between two elements of linkage of the snow plow described herein, although the spacer and two washers will not be specifically mentioned in conjunction with each of these pivoting connections made between two elements using a bolt. In addition, it will be understood by those skilled in the art that a pin retained by a cotter pin (not shown herein) could be used instead of a bolt and nut in many of the applications for a fastener used in the linkage discussed herein.

A hydraulic cylinder 416 is mounted at one end to the cylinder mounts 84 and 86 of the plow A-frame 50 using a bolt 418 which extends through the aperture 96 in the cylinder mount 84 and the aperture 98 in the cylinder mount 86, with a nut 420 being used to retain the bolt 418 in place. The other end of the hydraulic cylinder 416 drives the third corner of the triangular pivot plates 362 and 364 of the bellcrank 360, with a bolt 422 extending between the aperture 378 in the pivot plate 362 of the bellcrank 360 and the aperture 380 in the pivot plate 364 of the bellcrank 360. A nut 424 is used to retain the bolt 422 in place. The bolts 418 and 422 allow the hydraulic cylinder 416 to move as it drives the bellcrank 360. Spacers (not shown herein) may be used on each side of the other end of the hydraulic cylinder 416 on the insides of the pivot plates 362 and 364 to center the hydraulic cylinder 416.

The lift link 390 is used to connect the bellcrank 360 to pivot the lift bar 230. A bolt 426 is used to connect the lift link 390 to the lift bar 230, with the bolt 426 extending sequentially through the aperture 404 in the arm 392 of the lift link 390, the upper pin 272 from the end extending through the upper pin hanger plate 264 to the end extending through the upper pin hanger plate 266 of the lift bar 230, and the aperture 406 in the arm 394 of the lift link 390. A nut 428 is used to retain the bolt 426 in place. The bolt 426 allows the lift link 390 to pivot on the lift bar 230, and a spacer and two washers may also be used as mentioned hereinabove.

The second corner of the triangle formed by the pivot plates 362 and 364 of the bellcrank 360 drives the ends of the arms 392 and 394 of the lift link 390 which are not connected to the lift bar 230. Two bolts 430 are used to connect the bellcrank 360 to the lift link 390, with one of the bolts 430 also being used to mount a stand 432. The stand 432 is described in U.S. Pat. No. 5,894,688, to Struck et al., which patent is assigned to the assignee of the invention described herein. U.S. Pat. No. 5,894,688 is hereby incorporated herein by reference.

One bolt 430 (not shown) extends through the aperture 400 in the arm 392 of the lift link 390 and the aperture 374 of the pivot plate 362 of the bellcrank 360, with a nut 434 being used to retain the first bolt 430 in place, and a spacer and two washers may also be used as mentioned hereinabove. The other bolt 430 extends sequentially through an aperture (not shown) in the upper portion of the stand 432, the aperture 376 of the pivot plate 364 of the bellcrank 360, and the aperture 402 in the arm 394 of the lift link 390, with a nut 434 being used to retain the second bolt 430 in place. The second bolt 430 allows the lift link 390 to pivot on the bellcrank 360, and a spacer and two washers may again be used as mentioned hereinabove. A removable pin (not shown) extending through an aperture near the top of the stand 432 and apertures located in the lift link 390 is used to link the stand 432 with the lift link 390.

The hydraulic cylinder 416 is shown in FIG. 10 nearly in its fully retracted position. When the hydraulic cylinder 416 is fully extended, it will be appreciated by those skilled in the art that the lift bar 230 will rotate counterclockwise from the position in which it is shown in FIG. 10, and the stand 432 will be lowered to engage the ground (not shown) and thereby tend to lift the rear end of the plow A-frame 50 upwardly. It will also be appreciated that once the pins 408 and 410 are in engagement with the slots 328, 330, 332, and 334 in the hitch brackets 304, 306, 308, and 310, respectively, of the hitch frame nose piece 300, the hydraulic cylinder 416 may be used to align the apertures 286, 288, 290, and 292 on the lift bar 230 with the apertures 336, 338, 340, and 342, respectively, in the hitch brackets 304, 306, 308, and 310, respectively, of the hitch frame nose piece 300.

Referring now to FIGS. 11 through 14, a top plow blade frame 440 is illustrated which will define the top portion of the trip edge snow plow blade of the present invention. The top plow blade frame 440 is fundamentally defined by horizontal top and bottom members, with a plurality of vertical rib members extending therebetween. The top of the top plow blade 440 is a top rail 442 which extends the width of the top plow blade 440. The top rail 442 is essentially triangular in configuration, as best shown in cross-section in FIG. 21. The top rail 442 is preferably made of steel.

The bottom of the top plow blade 440 is a support angle 444 which also extends the width of the top plow blade 440. The support angle 444 may be thought of as two flat rectangular strips joined along their long edges at an angle which is approximately one hundred fifty degrees, as best shown in cross-section in FIG. 21. The support angle 444 is oriented with the wider strip extending from the bottom of the top plow blade 440 upwardly at the front side of the top plow blade 440, with the narrower strip extending from the top of the wider strip and oriented upwardly and somewhat rearwardly. The support angle 444 is also preferably made of steel.

Seven curved ribs extend between the top rail 442 and the support angle 444 and are mounted thereto, with the curvatures on these seven ribs defining the shape of the upper portion of the trip edge snow plow blade of the present invention. These seven ribs are preferably made of steel plate material, and are welded between the top rail 442 and the support angle 444. Two end ribs 446 and 448 are respectively located on the right and left sides of the top plow blade 440. The end ribs 446 and 448 extend below the support angle 444, and have apertures 450 and 452 respectively located therein near the ends thereof which extend below the support angle 444.

A pin rib 454 is located in the center of the top plow blade frame 440 intermediate the two end ribs 446 and 448. The pin rib 454 extends through a notch 456 located in the narrower strip of the support angle 444 at the midpoint thereof, and extends below the support angle 444. The pin rib 454 has an aperture 458 located therein near the end thereof which extends below the support angle 444.

A pair of spaced-apart blade attach ribs are located intermediate the pin rib 454 and each of the end ribs 446 and 448. Two spaced-apart blade attach ribs 460 and 462 are located intermediate the end rib 446 and the pin rib 454. Similarly, two spaced-apart blade attach ribs 464 and 466 are located intermediate the pin rib 454 and the end rib 448. The pair of blade attach ribs 460 and 462 are spaced apart sufficiently to admit the blade mounting bracket 170 (shown in FIG. 3), and the pair of blade attach ribs 464 and 466 are spaced apart sufficiently to admit the blade mounting bracket 172 (shown in FIG. 3). Additionally, the pair of blade attach ribs 460 and 462 and the pair of blade attach ribs 464 and 466 are spaced apart by the same distance as the blade mounting bracket 170 is spaced apart from the blade mounting bracket 172, to allow the top plow blade frame 440 to be installed onto the swing frame 140 (shown in FIG. 3).

The support angle 444 has two additional notches 468 and 470 which will be aligned with the spaces between the pairs of blade attach ribs 460 and 462 and 464 and 466. Specifically, the notch 468 in the support angle 444 is aligned with the space between the pair of blade attach ribs 460 and 462, and will admit the lower portion of the blade mounting bracket 170 of the swing frame 140 (best shown in FIG. 3) therein. Likewise, the notch 470 in the support angle 444 is aligned with the space between the pair of blade attach ribs 464 and 466, and will admit the lower portion of the blade mounting bracket 172 of the swing frame 140 (best shown in FIG. 3) therein.

Each of the blade attach ribs 460, 462, 464, and 466 has three apertures extending therethrough which will align with the apertures in the blade mounting brackets 170 and 172. Specifically, the blade attach rib 460 has three apertures 472 located therein, and the blade attach rib 462 has three apertures 474 located therein, with the apertures 472 and 474 being in relative alignment with the blade mounting apertures 182 in the blade mounting bracket 170 (best shown in FIG. 3). Likewise, the blade attach rib 464 has three apertures 476 located therein, and the blade attach rib 466 has three apertures 478 located therein, with the apertures 476 and 478 being in relative alignment with the blade mounting apertures 184 in the blade mounting bracket 172 (best shown in FIG. 3).

Figure 23:
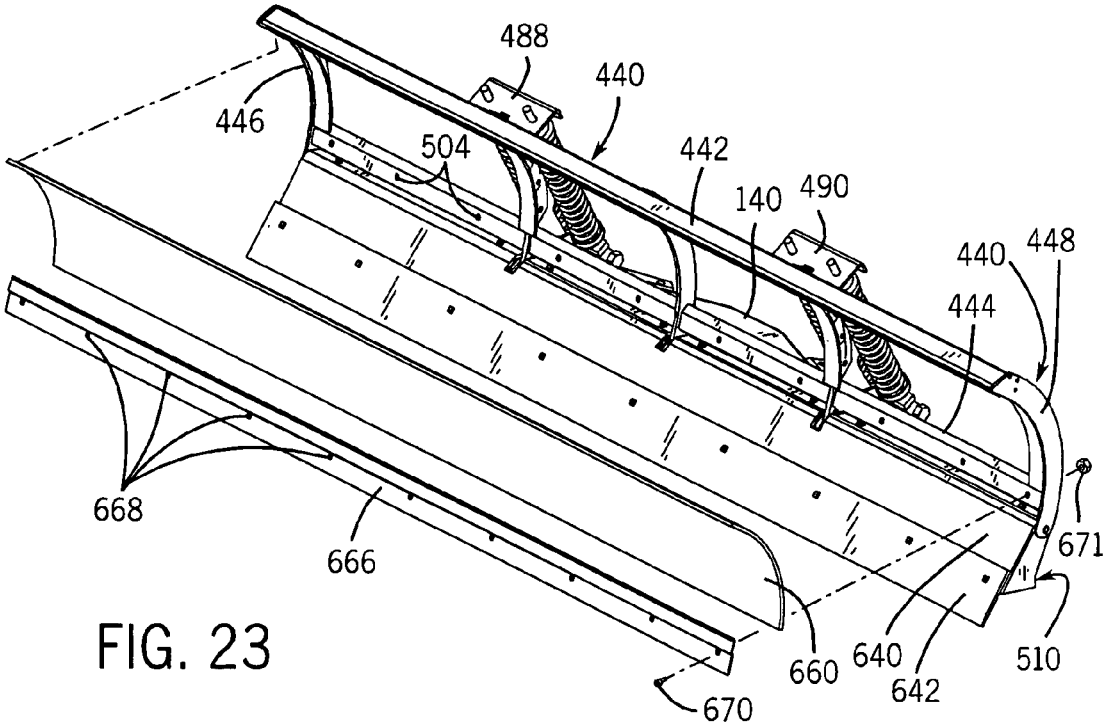
FIG. 23 is an isometric view showing the installation of an upper blade skin and a bottom skin retainer strip onto the assembly illustrated in FIG. 22, shown from the left side and the front.

Located on the front side of the top plow blade frame 440 are four curved rib face plates 480, 482, 484, and 486 which will support an upper blade skin (to be discussed below in conjunction with FIG. 23). The rib face plate 480 is made of steel, and is welded between the top rail 442 and the support angle 444, and onto the left side of the end rib 446. The rib face plate 482 is made of steel, and is welded between the top rail 442 and the support angle 444, and onto the front-facing edges of the blade attach ribs 460 and 462.

The rib face plate 484 is made of steel, and is welded between the top rail 442 and the support angle 444, and onto the front-facing edges of the blade attach ribs 464 and 466. The rib face plate 486 is made of steel, and is welded between the top rail 442 and the support angle 444, and onto the right side of the end rib 448. The rib face plates 480, 482, 484, and 486 together define a curved support surface for the upper blade skin (to be discussed below in conjunction with FIG. 23).

Also mounted on the top plow blade frame 440 are two spring brackets 488 and 490, which have notches 492 and 494, respectively, located therein at the forwardmost portions thereof. The notches 492 and 494 are used to mount the spring brackets 488 and 490, respectively, onto the top plow blade frame 440. The notch 492 of the spring bracket 488 receives the upper portions of the blade attach ribs 460 and 462 therein, allowing the spring bracket 488 to be mounted near the top of the top plow blade frame 440 and to extend rearwardly and slightly upwardly from the blade attach ribs 460 and 462.

Likewise, the notch 494 of the spring bracket 490 receives the upper portions of the blade attach ribs 464 and 466 therein, allowing the spring bracket 490 to be mounted near the top of the top plow blade frame 440 and to extend rearwardly and slightly upwardly from the blade attach ribs 464 and 466. The spring bracket 488 is made of steel, and is welded onto the top rail 442 and the blade attach ribs 460 and 462. Similarly, the spring bracket 490 is made of steel, and is welded onto the top rail 442 and the blade attach ribs 464 and 466.

Located in each of the spring brackets 488 and 490 are two apertures each of which will be used to receive rods which support trip edge springs (to be discussed below in conjunction with FIG. 20). Located in the spring bracket 488 are two apertures 496 and 498 which are situated on the right and left sides, respectively, of the notch 492 in the spring bracket 488. Similarly, located in the spring bracket 490 are two apertures 500 and 502 which are situated on the right and left sides, respectively, of the notch 494 in the spring bracket 490. Located in the support angle 444 at spaced-apart positions are ten apertures 504 which will be used to install an upper blade skin (to be discussed below in conjunction with FIG. 23).

Figure 15:
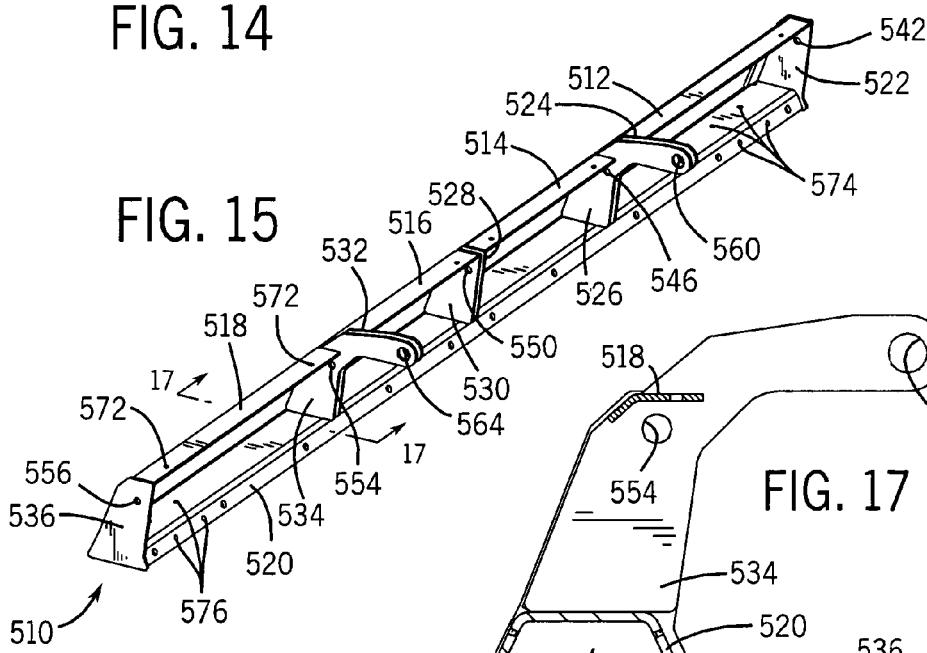
FIG. 15 is an isometric view of a trip edge blade frame constructed according to the teachings of the present invention, shown from the right side and the rear.
Figure 17:
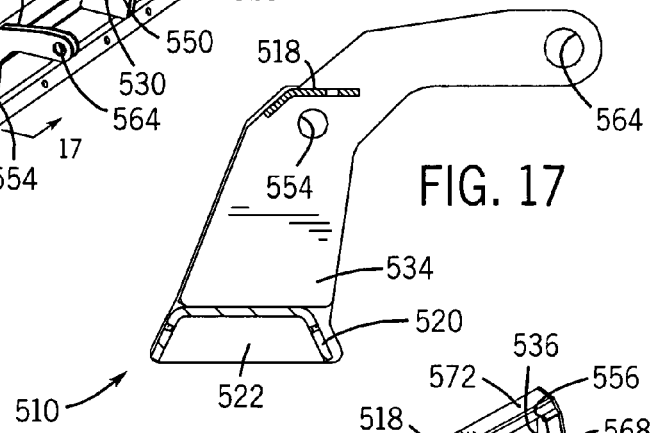
FIG. 17 is a cross-sectional view of the trip edge blade frame illustrated in FIGS. 15 and 16.
Figure 16:
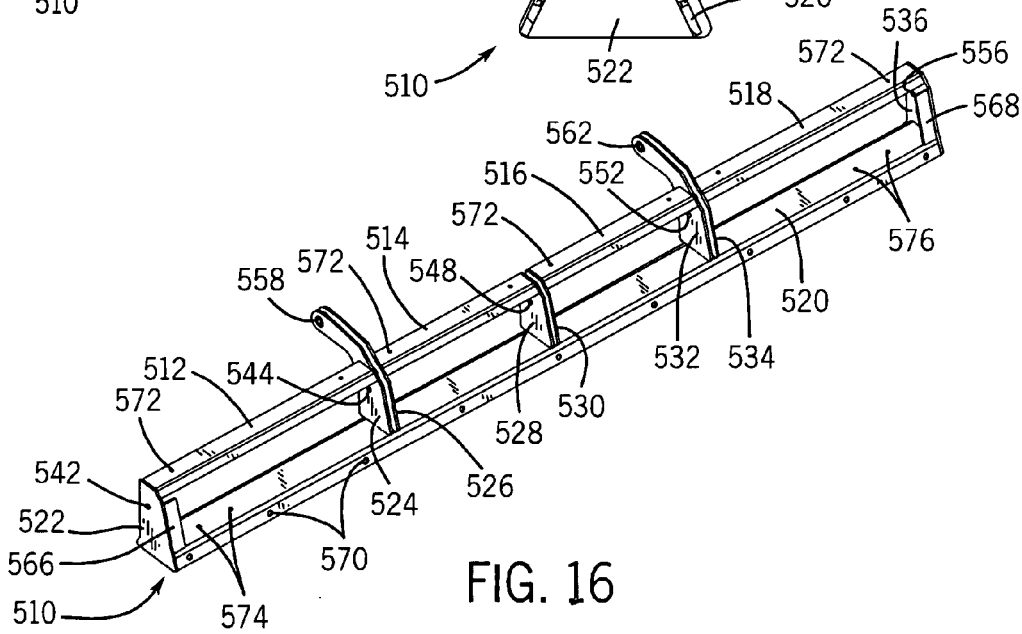
FIG. 16 is an isometric view of the trip edge blade frame illustrated in FIG. 15, shown from the right side and the front.

Turning next to FIGS. 15 through 17, a trip edge blade frame 510 is illustrated which will define the bottom portion of the trip edge snow plow blade of the present invention. The trip edge blade frame 510 is fundamentally defined by four horizontal top members and a bottom member, with a plurality of vertical rib members extending therebetween. From right to left, the top of the trip edge blade frame 510 is defined by four trip edge angles 512, 514, 516, and 518.

Each of the trip edge angles 512, 514, 516, and 518 may be thought of as two flat rectangular strips joined along their long edges at an angle which is approximately one hundred thirty-seven and a half degrees, as best shown in cross-section in FIG. 17. The trip edge angles 512, 514, 516, and 518 are oriented with the narrower strip extending from the top of the trip edge blade frame 510 downwardly at the front side of the trip edge blade frame 510, with the wider strip extending rearwardly from the top of the narrowed strip. The trip edge angles 512, 514, 516, and 518 are preferably made of steel.

The bottom of the trip edge blade frame 510 is a bottom rail 520 which extends the width of the trip edge blade frame 510. The bottom rail 520 of the trip edge blade frame 510 is made of a three sided channel resembling a wide, inverted "U" with the tops of the legs of the "U" angling outwardly as best shown in FIG. 17. The bottom rail 520 is also preferably made of steel.

Eight ribs extend between the trip edge angles 512, 514, 516, and 518 and the bottom rail 520. These eight ribs are preferably made of steel plate material, and are each welded between one of the trip edge angles 512, 514, 516, and 518 at the top end thereof, and the bottom rail 520 at the bottom end thereof. These ribs are, from right to left, a lower end rib 522, two blade pin ribs 524 and 526, two lower center ribs 528 and 530, two blade pin ribs 532 and 534, and a lower end rib 536.

The bottom of the lower end rib 522 is located on the right end of the bottom rail 520, and the top of the lower end rib 522 is located on the right end of the trip edge angle 512. The bottom of the lower end of the lower end rib 536 is located on the left side of the bottom rail 520, and the top of the lower end rib 536 is located on the left end of the trip edge angle 518. The rest of the ribs on the trip edge blade frame 510 are located in pairs, with the ribs in each pair being located close together, but with a space therebetween.

The blade pin ribs 524 and 526, the lower center ribs 528 and 530, and the blade pin ribs 532 and 534 all have their bottom ends located on top of the bottom rail 520. The blade pin rib 524 is located on the left side of the trip edge angle 512, and the blade pin rib 526 is located on the right side of the trip edge angle 514. The lower center rib 528 is located on the left side of the trip edge angle 514, and the lower center rib 530 is located on the right side of the trip edge angle 516. The blade pin rib 532 is located on the left side of the trip edge angle 516, and the blade pin rib 534 is located on the right side of the trip edge angle 518.

The width of the trip edge blade frame 510 is such that it will fit between the bottom ends of the end ribs 446 and 448 of the top plow blade frame 440 (best shown in FIGS. 11 and 12). In addition, when the trip edge blade frame 510 is located between the spaces between the end ribs 446 and 448 of the top plow blade frame 440, the spaces between the blade pin ribs 524 and 526, the lower center ribs 528 and 530, and the blade pin ribs 532 and 534 will be respectively aligned with the space between the blade attach ribs 460 and 462, the pin rib 454, and the space between the blade attach ribs 464 and 466 (all of which are best shown in FIGS. 11 and 12).

The lower end rib 522, the blade pin ribs 524 and 526, the lower center ribs 528 and 530, the blade pin ribs 532 and 534, and the lower end rib 536 have apertures 542, 544, 546, 548, 550, 552, 554, and 556, respectively, extending therethrough at a location near the top ends thereof, but below the levels of the trip edge angles 512, 514, 516, and 518, which will be used to pivotally mount the trip edge blade frame 510 from the top plow blade frame 440. The apertures 542, 544, 546, 548, 550, 552, 554, and 556 are coaxial and define an axis of rotation of the trip edge blade frame 510 with respect to the top plow blade frame 440 (best shown in FIGS. 11 and 12).

The blade pin ribs 524, 526, 532, and 534 each have a trailing arm which extends rearwardly and slightly upwardly, as best shown in the side view of the blade pin rib 534 in FIG. 17. The trailing arms in the blade pin ribs 524, 526, 532, and 534 have apertures 558, 560, 562, and 564, respectively, located near the distal ends thereof, which will be used to mount spring mechanisms to bias the trip edge blade frame 510 into an untripped position (which will be discussed below in conjunction with FIGS. 20 and 21). The apertures 558, 560, 562, and 564 are coaxial.

Located on the front side of the top plow blade frame 440 are two curved rib face plates 566 and 568 which will support the right and left edges of a lower blade skin (to be discussed below in conjunction with FIG. 22). The rib face plate 566 is made of steel, and is welded onto the top of the bottom rail 520 at the front edge and near the right side thereof and onto the left side of the lower end rib 522. The rib face plate 568 is also made of steel, and is welded onto the top of the bottom rail 520 at the front edge and near the left side thereof and onto the right side of the lower end rib 536.

Located on the front-facing edge of the bottom rail 520 as best shown in FIG. 16 are nine apertures 570 which will be used to mount both a lower blade skin (to be discussed below in conjunction with FIG. 22) and a wearstrip (also to be discussed below in conjunction with FIG. 22) onto the trip edge blade frame 510. Located in the top of each of the trip edge angles 512, 514, 516, and 518 are two apertures 572 which will be used both the mount the lower blade skin onto the trip edge blade frame 510.

Finally, located in the top and rear-facing edge of the bottom rail 520 near the right side thereof are a plurality of apertures 574 which will be used to mount a blade shoe to the right side of the trip edge blade frame 510. Similarly, located in the top and rear-facing edge of the bottom rail 520 near the left side thereof are a plurality of threaded apertures 576 which will be used to mount a blade shoe to the left side of the trip edge blade frame 510.

Figure 18:
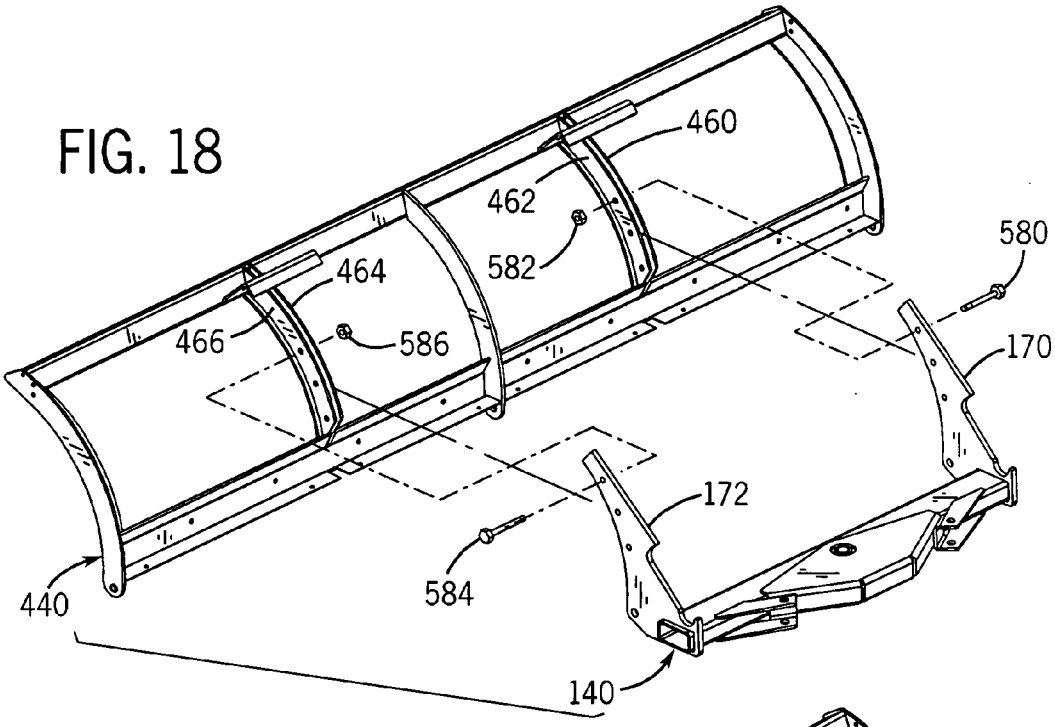
FIG. 18 is an isometric view showing the installation of the top plow blade frame illustrated in FIGS. 11 through 14 onto the plow swing frame illustrated in FIGS. 3 through 5, shown from the left side and the rear.

Moving now to FIG. 18, and referring as appropriate to reference numerals for the swing frame 140 in FIGS. 3 through 6 and to reference numerals for the top plow blade frame 440 in FIGS. 11 and 12, the installation of the top plow blade frame 440 onto the swing frame 140 is illustrated. The installation uses three bolts 580 and three nuts 582 for the right side and three bolts 584 and three nuts 586 for the left side (and may optionally use washers, lockwashers, or other hardware which is well known to those skilled in the art).

The swing frame 140 has the blade mounting bracket 170 located on the right side thereof, which is received intermediate the blade attach ribs 460 and 462 on the top plow blade frame 440. The three blade mounting apertures 182 in the blade mounting bracket 170 are aligned with the apertures 472 in the blade attach rib 460 and the apertures 474 in the blade attach rib 462. The three bolts 580 consecutively pass through the three apertures 472 in the blade attach rib 460, the three blade mounting apertures 182 in the blade mounting bracket 170, and the three apertures 474 in the blade attach rib 462. The three nuts 582 are used to secure the three bolts 580.

The swing frame 140 has the blade mounting bracket 172 located on the left side thereof, which are received intermediate the blade attach ribs 464 and 466 on the top plow blade frame 440. The three blade mounting apertures 184 in the blade mounting bracket 172 are aligned with the apertures 476 in the blade attach rib 464 and the apertures 478 in the blade attach rib 466. The three bolts 584 consecutively pass through the three apertures 476 in the blade attach rib 464, the three blade mounting apertures 184 in the blade mounting bracket 172, and the three apertures 478 in the blade attach rib 466. The three nuts 586 are used to secure the three bolts 584.

When the top plow blade frame 440 is mounted onto the swing frame 140, the apertures 450, 458, and 452 in the top plow blade frame 440 are linearly aligned with the apertures 186 and 188 in the swing frame 140 to define an axis of rotation for the trip edge blade frame 510 (best shown in FIG. 15). It will also be noted that the rectangular swing frame tube 142 of the swing frame 140 is located directly behind this axis of rotation. This location ensures proper transfer of forces from the trip edge snow plow blade of the present invention to the swing frame 140.

Figure 19:
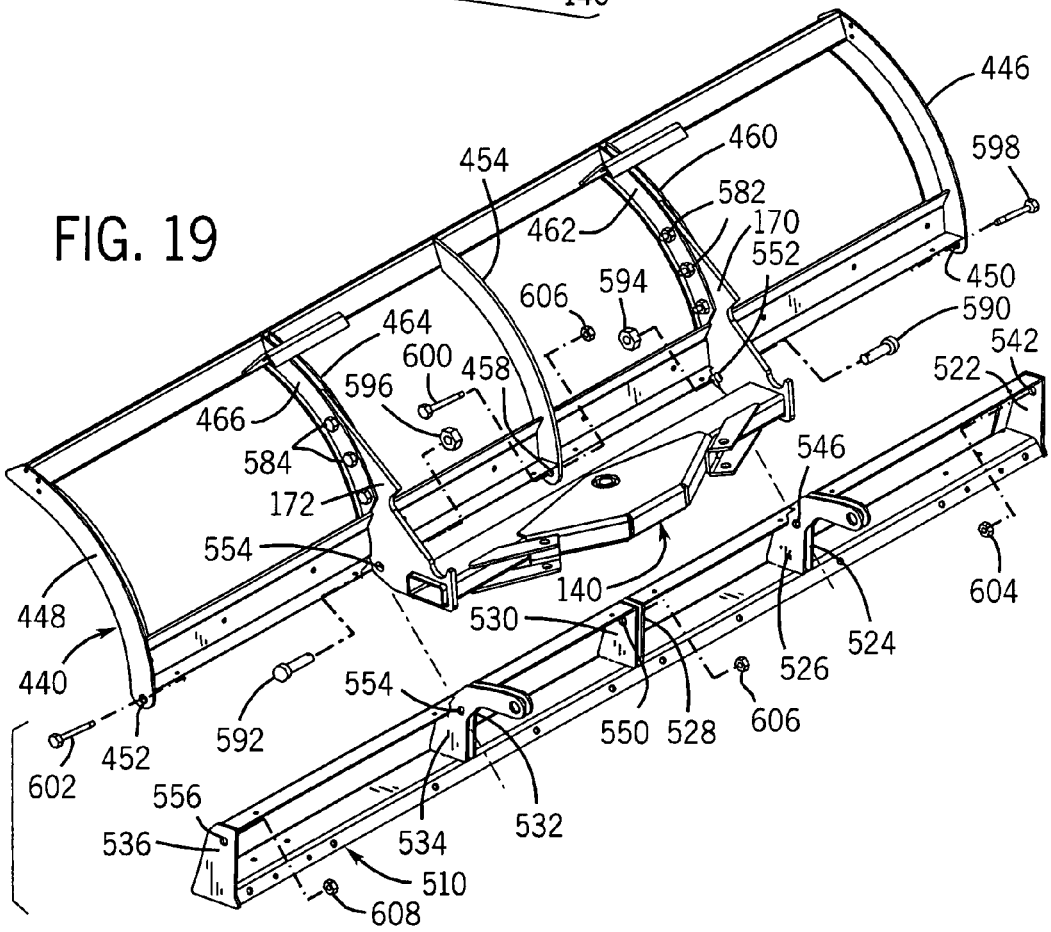
FIG. 19 is a an isometric view showing the installation of the trip edge blade frame illustrated in FIGS. 15 through 17 onto the assembly illustrated in FIG. 18, shown from the left side and the rear.

Referring next to FIG. 19, and referring as appropriate to reference numerals for the swing frame 140 in FIGS. 3 through 6, to reference numerals for the top plow blade frame 440 in FIGS. 11 and 12, and to reference numerals for the trip edge blade frame 510 in FIGS. 15 and 16, the installation of the trip edge blade frame 510 onto the swing frame 140 and the top plow blade frame 440 is illustrated. The installation uses two bolts 590 and 592 and two nuts 594 and 596 to install the trip edge blade frame 510 onto the swing frame 140. It also uses three bolts 598, 600, and 602 and three nuts 604, 606, and 608 to install the trip edge blade frame 510 onto the top plow blade frame 440. The installation of the trip edge blade frame 510 onto the swing frame 140 and the top plow blade frame 440 allows the trip edge blade frame 510 to pivot.

The brunt of the load of the trip edge blade frame 510 is carried by the swing frame 140. The portion of the blade mounting bracket 170 on the swing frame 140 which includes the aperture 186 is received intermediate the blade pin ribs 524 and 526 of the trip edge blade frame 510. The aperture 186 in the blade mounting bracket 170 is aligned with the aperture 544 in the blade pin rib 524 and the aperture 546 is the blade pin rib 526. The bolt 590 consecutively passes through the aperture 544 in the blade pin rib 524, the aperture 186 in the blade mounting bracket 170, and the aperture 546 in the blade pin rib 526. The nut 594 is used to secure the bolt 590.

The portion of the blade mounting bracket 172 on the swing frame 140 which includes the aperture 188 is received intermediate the blade pin ribs 532 and 534 of the trip edge blade frame 510. The aperture 188 in the blade mounting bracket 172 is aligned with the aperture 552 in the blade pin rib 532 and the aperture 554 is the blade pin rib 534. The bolt 592 consecutively passes through the aperture 554 in the blade pin rib 534, the aperture 188 in the blade mounting bracket 172, and the aperture 552 in the blade pin rib 532. The nut 596 is used to secure the bolt 592.

The trip edge blade frame 510 is maintained in proper alignment with the top plow blade frame 440 with the three bolts 598, 600, and 602. The distal end of the end rib 446 on the top plow blade frame 440 is located to the right of the lower end rib 522 on the trip edge blade frame 510, with the aperture 450 in the end rib 446 being aligned with the aperture 542 in the lower end rib 522. The bolt 598 extends through the aperture 450 in the end rib 446 and the aperture 542 in the lower end rib 522, and is secured in place with the nut 604.

The distal end of the pin rib 454 on the top plow blade frame 440 is located intermediate the lower center ribs 528 and 530 on the trip edge blade frame 510, with the aperture 458 in the pin rib 454 being aligned with the aperture 548 in the lower center rib 528 and the aperture 550 in the lower center rib 530. The bolt 600 consecutively passes through the aperture 550 in the lower center rib 530, the aperture 458 in the pin rib 454, and the aperture 548 in the lower center rib 528, and is secured in place with the nut 606.

The distal end of the end rib 448 on the top plow blade frame 440 is located to the left of the lower end rib 536 on the trip edge blade frame 510, with the aperture 452 in the end rib 448 being aligned with the aperture 556 in the lower end rib 536. The bolt 602 extends through the aperture 452 in the end rib 448 and the aperture 556 in the lower end rib 536, and is secured in place with the nut 608.

Figure 20:
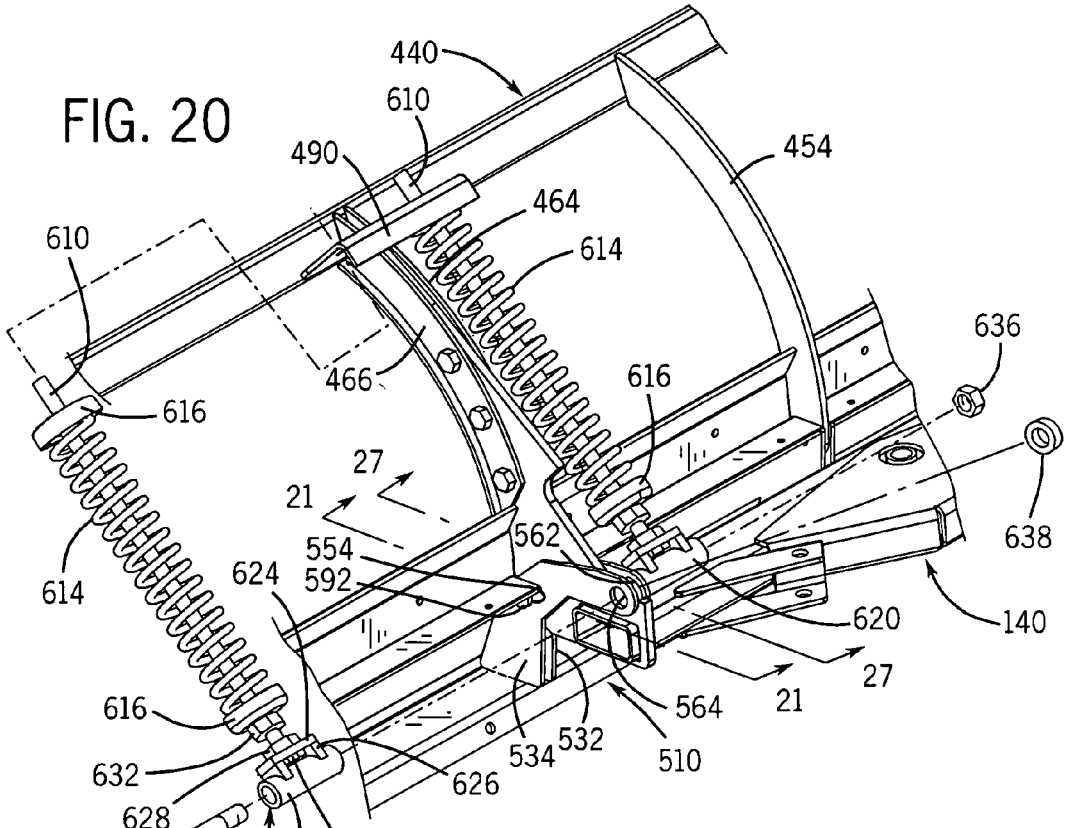
FIG. 20 is a partial isometric view of two spring assemblies constructed according to the teachings of the present invention which are installed on the left side of the assembly illustrated in FIG. 19, shown from the left side and the rear.
Figure 21:
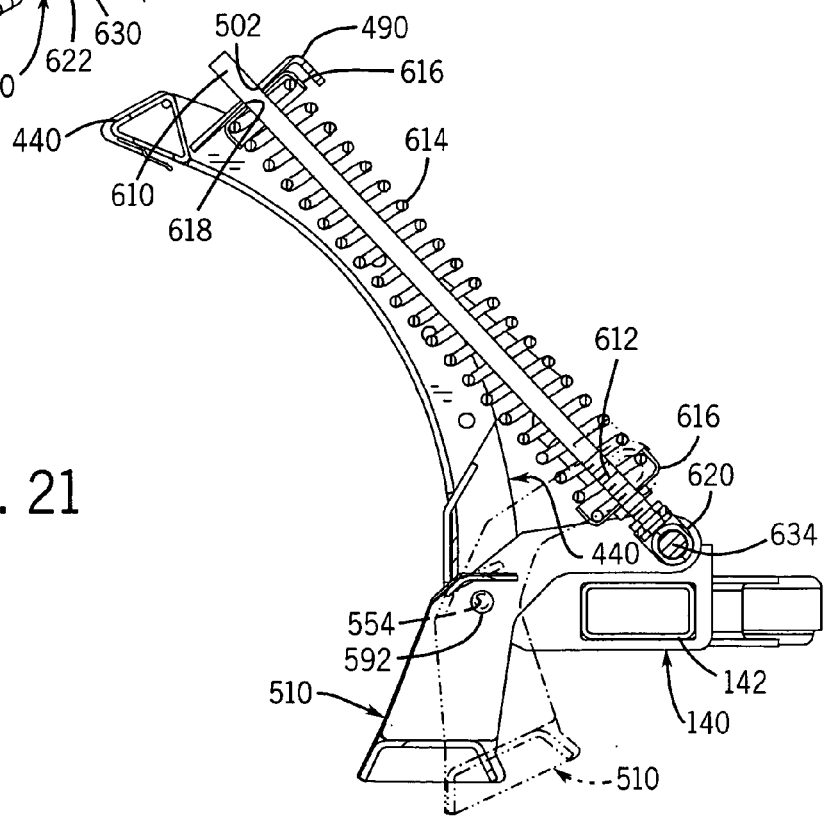
FIG. 21 is a cross-sectional view of the assembly illustrated in FIG. 20 showing one of the spring assemblies.

Referring next to FIGS. 20 and 21, and referring as appropriate to reference numerals for the top plow blade frame 440 in FIGS. 11 and 12 and to reference numerals for the trip edge blade frame 510 in FIGS. 15 and 16, the installation of two trip edge spring assemblies onto the left side of the trip edge blade frame 510 and the top plow blade frame 440 is illustrated. The trip edge snow plow blade of the present invention uses four identical trip edge spring assemblies (two on each side), which all share the same reference numerals. Additionally, the installation of two trip edge spring assemblies onto the right side of the trip edge blade frame 510 and the top plow blade frame 440 is identical to the installation of the two trip edge spring assemblies onto the left side of the trip edge blade frame 510 and the top plow blade frame 440, and so is not illustrated in FIGS. 20 and 21.

During the discussion of the installation of the two trip edge spring assemblies onto the left side of the trip edge blade frame 510 and the top plow blade frame 440, it should be noted that the lower ends of the two spring assemblies are mounted to the blade pin ribs 532 and 534 of the trip edge blade frame 510, and the upper ends of the two spring assemblies are mounted to the spring bracket 490 of the top plow blade frame 440. It will be appreciated by those skilled in the art that while the upper ends of the two spring assemblies are mounted to the spring bracket 490 of the top plow blade frame 440, the load will be carried by the blade mounting bracket 172 of the swing frame 140 (best shown in FIG. 3). As such, the trip edge spring assemblies do not exert significant force upon the top plow blade frame 440, but rather upon the swing frame 140 and the trip edge blade frame 510.

Each trip edge spring assembly consists of five major components and three nuts. The major components are a steel spring rod 610 having a threaded portion 612 at its lower end, a trip edge spring 614 made of spring steel, two steel spring support cups 616 each having a centrally located aperture 618 located therein, and a saddle assembly 620 which is also made of steel. The upper portions of the two spring rods 610, which are not threaded, respectively extend through the apertures 500 and 502 in the spring bracket 490. A trip edge spring 614 is mounted on each of the spring rods 610, with a spring support cup 616 being located at each end of each of the trip edge springs 614. The spring rods 610 extend through the apertures 618 in the spring support cups 616, which as their name suggests are cup-shaped.

Each of the saddle assemblies 620 consists of a hollow cylindrical segment 622 having a support plate 624 which is mounted in a position spaced away from the cylindrical segment 622 with support members 626 which are located at each end of the support plate 624. The end of each spring rod 610 which has the threaded portion 612 is mounted onto the support plate 624 of the saddle assembly 620. Two nuts 628 and 630 on the threaded portions 612 of the spring rods 610 on opposite sides of the support plates 624 retain the spring rods 610 in position on the saddle assembly 620.

A third nut 632 mounted on the threaded portion 612 of each of the spring rods 610 is used to adjust the pretension on the trip edge springs 614. On the left side of the trip edge blade frame 510, the two saddle assemblies 620 are respectively mounted on the right side of the blade pin rib 532 and the left side of the blade pin rib 534. A bolt 634 and a nut 636 are used to mount the saddle assemblies 620 to the trip edge blade frame 510. The bolt 634 extends through the left-most saddle assembly 620, the aperture 564 in the blade pin rib 534, the aperture 562 in the blade pin rib 532, and the right-most saddle assembly 620, and is secured by the nut 636.

A hollow cylindrical blade trip stop 638 resembling a thick washer is mounted on the bolt 634 intermediate the blade pin ribs 532 and 534. The blade trip stop 638 is made of a high density polymeric material such as polyurethane, and is located so as to contact the curved upper stop 200 of the blade mounting bracket 172 and the curved lower stop 198 of the blade mounting bracket 172 before the trip edge blade frame 510 reaches either the tripped position or the trip return position. The polymeric material of which the blade trip stop 638 is made is capable of absorbing a considerable impact, and is resilient and wear-resistant as well.

Figure 22:
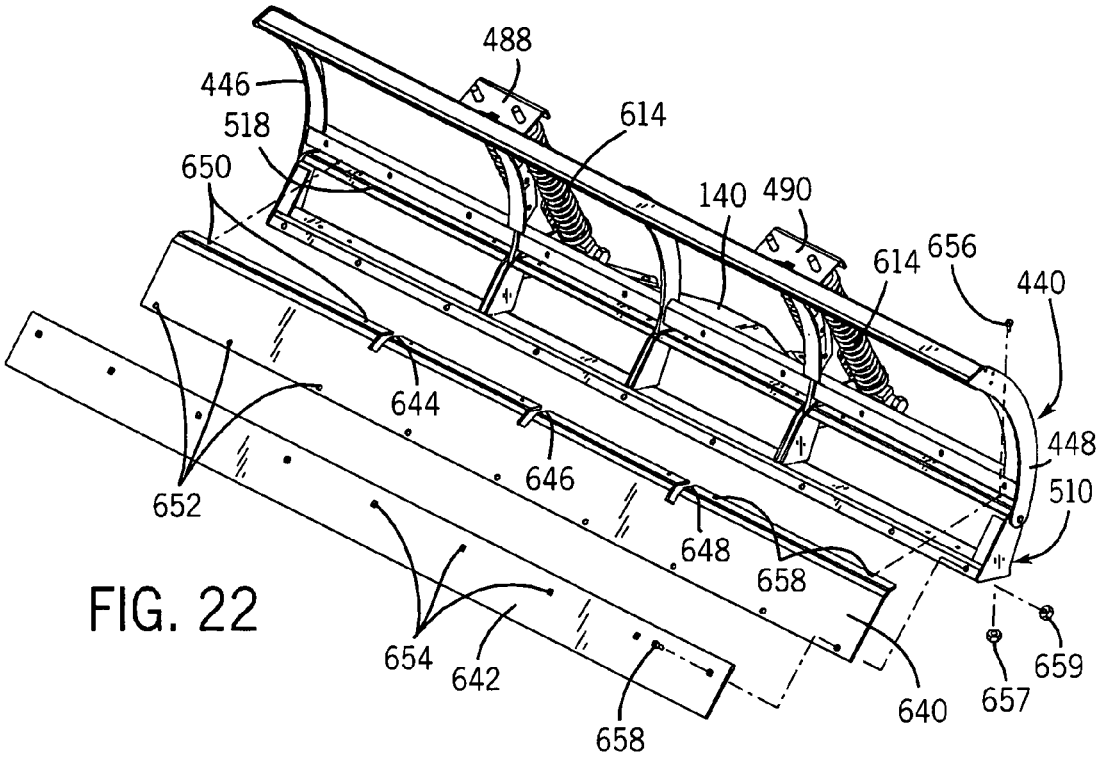
FIG. 22 is an isometric view showing the installation of a lower blade skin and a wearstrip onto the assembly illustrated in FIGS. 20 and 21, shown from the left side and the front.

Referring next to FIG. 22, and referring as appropriate to reference numerals for the trip edge blade frame 510 in FIGS. 15 and 16, the installation of a lower blade skin 640 and a wearstrip 642 onto the trip edge blade frame 510 is illustrated. The lower blade skin 640 is preferably made of stainless steel, and has a front portion which will cover the front face of the trip edge blade frame 510 and a top portion which is angled back from the front portion and will substantially cover the top surface of the trip edge blade frame 510. The wearstrip 642, which is approximately the same width as the support angle 444, is preferably made of a high carbon steel such as AISI 1080 high carbon steel.

The top portion of the lower blade skin 640 has three notches 644, 646, and 648 located therein. When the lower blade skin 640 is mounted onto the trip edge blade frame 510, the notch 644 will receive the upper portions of the blade pin ribs 524 and 526 (and the blade mounting bracket 170 of the swing frame 140 which is located therebetween), the notch 646 will receive the pin rib 454 of the top plow blade frame 440, and the notch 648 will receive the upper portions of the blade pin ribs 532 and 534 (and the blade mounting bracket 172 of the swing frame 140 which is located therebetween).

Extending across the top portion of the lower blade skin 640 are a plurality of apertures 650 which are used to mount the top portion of the lower blade skin 640 to the trip edge angles 512, 514, 516, and 518 of the trip edge blade frame 510. Extending across the bottom of the front portion of the lower blade skin 640 are a plurality of apertures 652 which are used to mount the bottom of the front portion of the lower blade skin 640 to the front of the bottom rail 520 of the bottom rail 520. Extending across the wearstrip 642 near the top thereof are a plurality of apertures 654 which are used to mount the wearstrip 642 onto the bottom rail 520.

A plurality of bolts 656 extend through the apertures 650 in the top portion of the lower blade skin 640 and the apertures 572 in the trip edge angles 512, 514, 516, and 518 of the trip edge blade frame 510, and are retained by a respective plurality of nuts 657. A plurality of bolts 658 extend sequentially through the apertures 654 in the wearstrip 642 and the apertures 652 in the front portion of the lower blade skin 640, and then through the apertures 570 in the front of the bottom rail 520 of the trip edge blade frame 510, and are retained by a respective plurality of nuts 659. The front of the support angle 444 is arranged and configured such that the wearstrip 642 will be mounted with its bottom edge angled forwardly with respect to the ground at angle of between approximately zero and forty-five degrees, with between approximately fifteen and thirty degrees being preferred, and an angle of approximately twenty-five degrees being most preferred.

Figure 14:
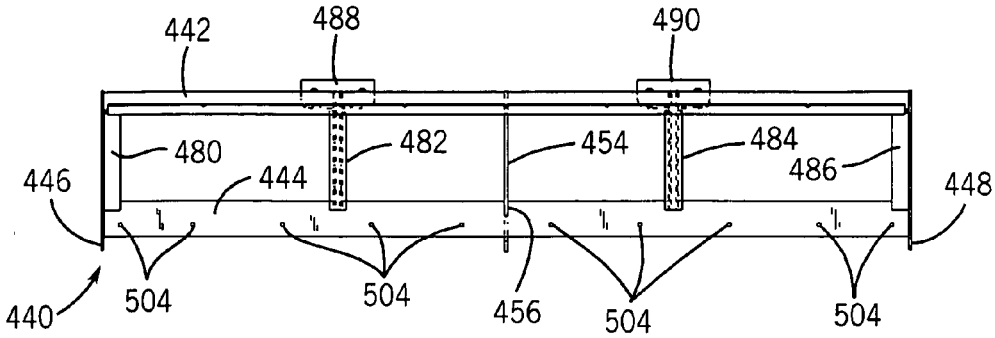
FIG. 14 is a front view of the top plow blade frame illustrated in FIGS. 11 through 13.

Moving now to FIGS. 23 through 26, and referring as appropriate to reference numerals for the top plow blade frame 440 in FIG. 14, the installation of the installation of an upper blade skin 660 onto the top plow blade frame 440 is illustrated. The upper blade skin 660 is preferably made of steel, and is laterally restrained by the end ribs 446 and 448, which extend slightly forwardly from the rest of the top plow blade frame 440 to prevent the upper blade skin 660 from moving laterally once it has been installed on the top plow blade frame 440.

Extending across the front side of the top rail 442 of the top plow blade frame 440 is a top skin retainer strip 662 (best shown in FIG. 25), into which the top edge of the upper blade skin 660 fits and is retained. The top skin retainer strip 662, which is shown as being bolted to the top rail 442 with a plurality of bolts 664 (but which may alternately be riveted or welded to the top rail 442), is bent slightly toward the top rail 442, which ensures that the top edge of the upper blade skin 660 fits snugly therein. Thus, it will be appreciated that the top, right, and left sides of the upper blade skin 660 are retained in position on the plow blade 440.

Figure 24:
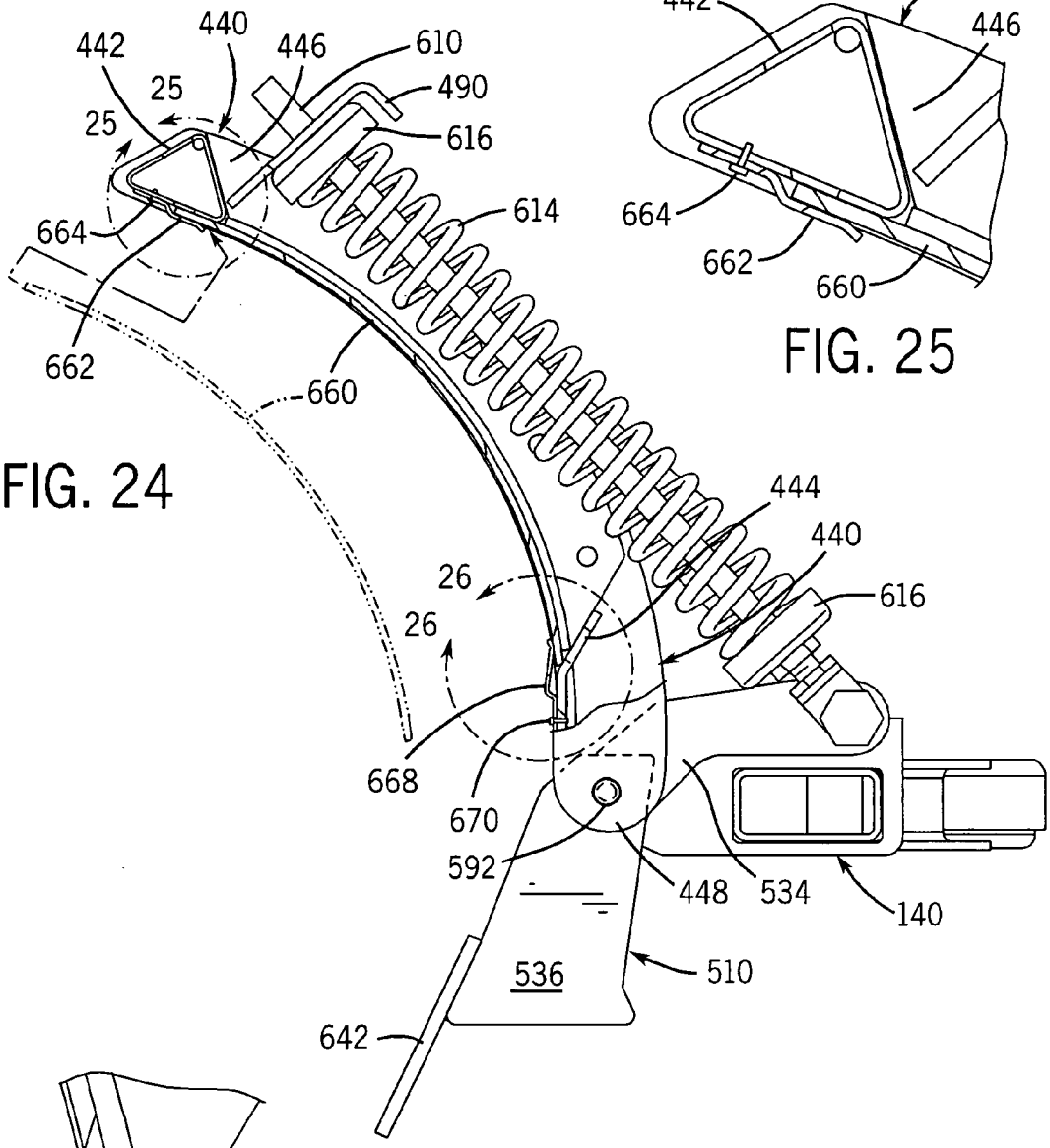
FIG. 24 is a cross-sectional view of the assembly illustrated in FIG. 23.
Figure 25:
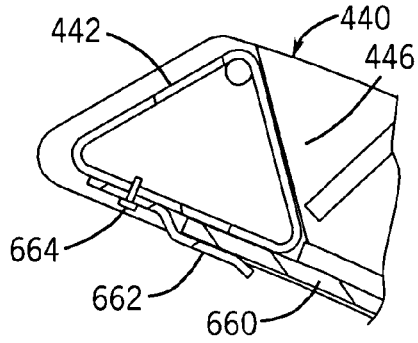
FIG. 25 is an enlarged partial cross-sectional view of a portion of the apparatus illustrated in FIG. 24, showing a top skin retainer strip used to retain the top edge of the upper blade skin.
Figure 26:
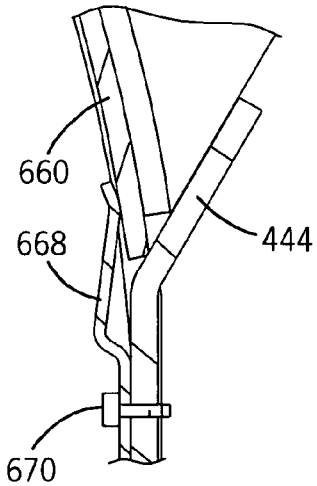
FIG. 26 is an enlarged partial cross-sectional view of a portion of the apparatus illustrated in FIG. 24, showing the bottom skin retainer strip used to retain the bottom edge of the upper blade skin.

The bottom edge of the upper blade skin 660 comes just to the top of the support angle 444, as best shown in FIG. 24. A bottom skin retainer strip 666 is used to retain the bottom edge of the upper blade skin 660. The bottom skin retainer strip 666 extends across the front side of the support angle 444 of the top plow blade frame 440 and has a plurality of apertures 668 located therein. A plurality of bolts 670 extend through the apertures 668 in the bottom skin retainer strip 666, and into the apertures 504 in the support angle 444 at the bottom of the top plow blade frame 440, and are retained by a respective plurality of nuts 671.

Referring next to FIGS. 27 through 30, the operation of the trip edge snow plow blade of the present invention is illustrated with respect to an obstacle 680 which is fixedly located (for example, by freezing) in the ground 682. One variation is illustrated in these figures—the blade trip stop 638 is shown as having a thin outer steel cylinder 682 over an inner resilient core 684. This configuration may improve the wear characteristics of the blade trip stop 638.

Initially, the trip edge blade frame 510 is in the position shown in FIG. 27, which shows the trip edge snow plow blade drawing near to the obstacle 680, which may be, for example, a rock frozen in the ground. At this point, the trip edge blade frame 510 is in its untripped position and the blade trip stop 638 is located at rest adjacent to the curved lower stop 198 in the blade mounting bracket 172. (The blade trip stop 638 at the other side of the trip edge snow plow blade would be in the same position.)

As the wearstrip 642 on the trip edge blade frame 510 contacts the obstacle 680, the trip edge blade frame 510 will rotate around its pivot point, with the bottom of the trip edge blade frame 510 and the wearstrip 642 moving rearwardly as shown in FIG. 28. The blade trip stop 638 will move out of contact with the curved lower stop 198 in the blade mounting bracket 172 and will move toward the curved upper stop 200 in the blade mounting bracket 172. As the trip edge blade frame 510 moves from its untripped position to its tripped position, it will compress the trip edge springs 614 as shown in FIG. 28. When the trip edge blade frame 510 is in its fully tripped position, the blade trip stop 638 will be located adjacent to the curved upper stop 200 in the blade mounting bracket 172. This movement of the blade trip stop 638 is illustrated in FIG. 30.

One of the significant design aspects of the trip edge blade frame 510 and the tripping mechanism are the locations from which and the angles at which the trailing arms of the blade pin ribs 524, 526, 532, and 534 extend, together with the geometry of the connection of the trailing arms to the trip edge springs. Referring to FIGS. 27 and 28, it will be appreciated that the design of the blade pin ribs 524, 526, 532, and 534 results in a substantially linear progressively increasing force being applied by the trip edge springs 614 to the trip edge blade frame 510 as it moves from the untripped position to the fully tripped position. This is achieved by the moment arm remaining relatively constant over the full range of trip edge blade movement in the trip edge snow plow blade of the present invention. This is in stark contrast to previously known trip edge plows which have the compressive force flattening out and then dropping off as the trip blade moves from its untripped position to its fully tripped position.

The benefits of having a linear progressively increasing force tripping action as opposed to a non-linear tripping action as in previously known snow plows is twofold: a quicker return of the trip edge blade is achieved, and the trip edge blade is better able to plow in a partially deflected position. This is because a non-linear tripping trip edge blade will not return as quickly as a linearly tripping trip edge blade, because the biasing force slacks off as the trip edge blade approaches the fully tripped position. With a linear progressively increasing force tripping action, the biasing forces increase progressively. Additionally, a non-linear tripping action will allow the trip edge blade to move to the fully tripped position and will not provide sufficient force to return the trip edge blade to its untripped position during plowing, but rather will require that the truck be stopped so that the trip edge blade may return to its untripped position. The linear progressively increasing force relationship, allows the trip edge blade to be able to continue plowing while remaining partially deflected.

Referring now to FIGS. 31 and 32, the trip edge snow plow blade of the present invention is shown in its fully assembled form. It will be appreciated from these figures that the spring assemblies illustrates in the earlier figures on the left side of the trip edge snow plow blade are duplicated on the right side of the trip edge snow plow blade. From these figures, and particularly from FIG. 32, it may be seen that the tripping action of the trip blade exerts forces which will act upon the swing frame 140 and not upon the top plow blade frame 440.

Although the trip edge springs 614 are supported at their top ends by the spring brackets 488 and 490, which are mounted on the pairs of blade attach ribs 460 and 462, and 464 and 466, respectively, since these members are mounted on the blade mounting brackets 170 and 172, respectively, of the swing frame 140, the forces will be borne by the swing frame 140. The bottom ends of the trip edge springs 614 bear on the pairs of blade pin ribs 524 and 526, and 532 and 534, which are mounted on the blade mounting brackets 170 and 172, respectively.

From FIG. 32 it may also be seen that the axis of rotation for the trip blade is directly in front of the swing frame 140, and as such there is no moment arm which will produce a torsional force in the mounting apparatus for the trip edge snow plow blade of the present invention. This reduces the forces of impact (due to striking an object) that must be borne by the plow A-frame 50 to strictly compressive forces, a highly advantageous characteristic of the trip edge snow plow blade of the present invention. In addition, the relatively high trip blade (approximately ten inches (25.4 cm) in the preferred embodiment) ensures that obstacles such as a curb hidden in the snow will not cause damage to the plow blade.

Optionally, a back blade wearstrip 686 is mounted onto the rear-facing side of the bottom rail 520 of the trip edge blade frame 510 and extends substantially across the width of the trip edge blade frame 510. The back blade wearstrip 686 is mounted onto the rear-facing side of the bottom rail 520 with a plurality of bolts 687. The back blade wearstrip 686 is permanently mounted at an optimum angle with respect to the ground which is defined by the angle of the trip edge blade frame 510. The back blade wearstrip 686 will be mounted with its bottom edge angled rearwardly with respect to the ground at angle of between approximately zero and forty-five degrees, with between approximately fifteen and thirty degrees being preferred, and an angle of approximately twenty-five degrees being most preferred. In the preferred embodiment, the wearstrip 642 and the back blade wearstrip 686 may be mounted at approximately the same angles, but with the wearstrip 642 being angled forwardly and the back blade wearstrip 686 being angled rearwardly.

Turning next to FIG. 33, the assembly of the trip edge snow plow blade of the present invention onto the plow A-frame 50 and the assembled linkage of FIGS. 6 and 8 through 10 is illustrated. The swing frame 140 is pivotally mounted onto the plow A-frame 50 with a bolt 688. A light support bar 690 is mounted on the top ends of the light support towers (not shown herein) which are mounted on the light bar supports 244 and 246, respectively, of the lift bar 230 (shown in FIG. 6). Lights (not shown herein) would be mounted on the light support bar 690, in a manner well known to one skilled in the art.

In addition, right and left swing cylinders 692 and 694, respectively, are mounted between the plow A-frame 50 and the swing frame 140. The right swing cylinder 692 extends between the swing cylinder mount 76 on the plow A-frame 50 (where it is secured with a pin 696) and the swing cylinder bracket 158 on the swing frame 140 (where it is secured with a pin 698), and the left swing cylinder 694 extends between the swing cylinder mount 78 on the plow A-frame 50 (where it is secured with a pin 700) and the swing cylinder bracket 160 on the swing frame 140 (where it is secured with a pin 702). It will be understood that the pins 696, 698, 700, and 702 are all retained in place with cotter pins (not shown) as is well known to those skilled in the art.

Also not shown or discussed herein is the hydraulic system to operate the snow plow, the construction and operation of which is also well known to those skilled in the art. The right and left swing cylinders 692 and 694 are used to pivot the swing frame 140 and the plow blade on the plow A-frame 50. The hydraulic system for the snow plow (not shown herein) may be mounted on the plow A-frame 50 at the front thereof.

Also shown in FIG. 33 are optional shoes 704 and 706, which are installed on the trip edge blade frame 510. The shoes 704 and 706 are designed to ride in sliding contact with the surface to be plowed, and are particularly useful on gravel or during the spring when the ground may not be fully frozen. The shoes 704 and 706 are mounted to the bottom rail 520 of the trip edge blade frame 510 using shoe mounts 708 and 710, respectively. The shoe mount 708 is mounted on the bottom rail 520 near the right side thereof, and the shoe mount 710 is mounted on the bottom rail 520 near the left side thereof. The shoe mounts 708 and 710 are preferably made of steel and may be either bolted (using the apertures 574 and 576, respectively) or welded onto the bottom rail 520.

The shoes 704 and 706 are mounted on posts 712 and 714, respectively, which posts 712 and 714 are received by the shoe mounts 708 and 710, respectively. The shoes 704 and 706 are adjusted using a combination of washers and tubular spacers, which are placed on the posts 712 and 714 either below or above the shoe mounts 708 and 710 to adjust the height of the shoes 704 and 706. The position of the shoes 704 and 706 relative to the trip edge blade frame 510 may be adjusted to adjust the height of the trip edge blade frame 510 relative to the surface to be plowed. This allows the degree to which the wearstrip 642 scrapes the surface to be plowed to be controlled. Retaining clips 716 and 718 are used on the posts 712 and 714, respectively, to retain them in the shoe mounts 708 and 710.

The shoes 704 and 706 are typically made out of cast iron. The shoes 704 and 706 have feet which are adapted to ride in sliding contact with the surface to be plowed. The position of the feet relative to the plow blade may be adjusted to adjust the height of the plow blade relative to the surface to be plowed. In this way, the degree to which the wearstrip 642 scrapes the surface to be plowed may be controlled.

It may therefore be appreciated from the above detailed description of the preferred embodiment of the present invention that it teaches a trip edge snow plow blade which is mounted onto the swing frame of the snow plow so that the swing frame, and thus the supporting frame of the snow plow, provides at least a substantial portion of the support for the trip edge snow plow blade. Accordingly, the forces inherent in the tripping action of the trip edge snow plow blade are transmitted directly to the swing frame and the supporting frame of the snow plow rather than being transmitted to the upper snow plow blade. In addition, the hinge mechanism used to pivotally mount the trip edge snow plow blade of the present invention is not exposed at the front of the snow plow blade where it would be susceptible to potential damage caused by objects struck by the snow plow.

The axis of rotation of the trip edge snow plow blade of the present invention is located at the height of the supporting frame of the snow plow in order to prevent the creation of torsional forces and to ensure that the load imparted to the supporting frame be substantially compressive in nature. The forces of the springs which bias the trip edge snow plow blade of the present invention into an untripped position are carried by the swing frame of the snow plow rather than being exerted upon the upper snow blow blade. The trip edge blade portion of the trip edge snow plow blade of the present invention is also substantially higher than the height of most previously known trip edge snow plow blades to prevent damage to the upper snow plow blade due to impacts with curbs or other high obstacles.

The trip edge snow plow blade of the present invention is of a construction which is both durable and long lasting, and which will require little or no maintenance to be provided by the user throughout its operating lifetime. The trip edge snow plow blade of the present invention is also of relatively inexpensive construction to enhance its market appeal and to thereby afford it the broadest possible market. Finally, all of the aforesaid advantages and objectives of the trip edge snow plow blade of the present invention are achieved without incurring any substantial relative disadvantage.

Although the foregoing description of the present invention has been shown and described with reference to particular embodiments and applications thereof, it has been presented for purposes of illustration and description and is not intended to be exhaustive or to limit the invention to the particular embodiments and applications disclosed. It will be apparent to those having ordinary skill in the art that a number of changes, modifications, variations, or alterations to the invention as described herein may be made, none of which depart from the spirit or scope of the present invention. The particular embodiments and applications were chosen and described to provide the best illustration of the principles of the invention and its practical application to thereby enable one of ordinary skill in the art to utilize the invention in various embodiments and with various modifications as are suited to the particular use contemplated. All such changes, modifications, variations, and alterations should therefore be seen as being within the scope of the present invention as determined by the appended claims when interpreted in accordance with the breadth to which they are fairly, legally, and equitably entitled.

What is claimed is:

1. A trip edge snow plow blade, said trip edge snow plow blade being mounted on a snow plow frame which may be installed at the front of a vehicle, said trip edge snow plow blade comprising:

a blade support frame member with right and left ends, said blade support frame member being supported from the snow plow frame which may be installed at the front of the vehicle;

an upper snow plow blade fixedly mounted on said blade support frame member;

a trip edge blade pivotally mounted on said blade support frame member, said trip edge blade being pivotable about a blade trip axis between a blade return position and a blade tripped position, wherein said trip edge blade is mounted at a location below said upper snow plow blade; and blade biasing members which exert forces to bias said trip edge blade from said blade tripped position to said blade return position.

2. A trip edge snow plow blade as defined in claim 1, wherein said blade support member comprises;

a frame member for pivotable mounting on the snow plow frame;

a right blade mounting bracket mounted at said right end of said frame member; and a left blade mounting bracket mounted at said left end of said frame member.

3. A trip edge snow plow blade as defined in claim 2, wherein said upper snow plow blade is fixedly mounted onto said right and left blade mounting brackets.

4. A trip edge snow plow blade as defined in claim 3, wherein said upper snow plow blade comprises:

a plurality of blade attach ribs located in parallel vertical planes, wherein at least one of said blade attach ribs is fixedly mounted onto said right blade mounting bracket of said blade support member, and wherein at least one of said blade attach ribs is fixedly mounted onto said left blade mounting bracket of said blade support member.

5. A trip edge snow plow blade as defined in claim 4, wherein said upper snow plow blade comprises:

a first pair of blade attach ribs located in one of said parallel vertical planes, wherein said right blade mounting bracket of said blade support member is located intermediate said first pair of blade attach ribs, said first pair of blade mounting ribs being fixedly mounted to said right blade mounting bracket of said blade support member; and a second pair of blade attach ribs located in one of said parallel vertical planes, wherein said left blade mounting bracket of said blade support member is located intermediate said second pair of blade attach ribs, said second pair of blade mounting ribs being fixedly mounted to said left blade mounting bracket of said blade support member.

6. A trip edge snow plow blade as defined in claim 2, wherein said trip edge blade is pivotally mounted on said right and left blade mounting brackets.

7. A trip edge snow plow blade as defined in claim 6, wherein said trip edge blade comprises:

a plurality of blade pin ribs located in parallel vertical planes, wherein at least one of said blade pin ribs is pivotally mounted on said right blade mounting bracket of said blade support member, and wherein at least one of said blade pin ribs is pivotally mounted on said left blade mounting bracket of said blade support member.

8. A trip edge snow plow blade as defined in claim 7, wherein said trip edge blade comprises:

a first pair of blade pin ribs located in one of said parallel vertical planes, wherein said right blade mounting bracket of said blade support member is located intermediate said first pair of blade pin ribs, said first pair of blade pin ribs being pivotally mounted to said right blade mounting bracket of said blade support member; and a second pair of blade pin ribs located in one of said parallel vertical planes, wherein said left blade mounting bracket of said blade support member is located intermediate said second pair of blade pin ribs, said second pair of blade pin ribs being pivotally mounted to said left blade mounting bracket of said blade support member.

9. A trip edge snow plow blade as defined in claim 1, wherein said trip edge blade comprises:

a plurality of rearwardly extending arms which extend from said trip edge blade and have distal ends, wherein said blade biasing members are located between said distal ends of said blade pin arms and members which are fixedly mounted on said blade support frame member.

10. A trip edge snow plow blade as defined in claim 9, wherein said rearwardly extending arms are mounted onto said trip edge blade at a location and angle which, together with the geometry of the connection of said rearwardly extending arms to said blade biasing members, provide a substantially linear progressively increasing force to said trip edge blade as it moves from said blade return position to said blade tripped position.

11. A trip edge snow plow blade as defined in claim 9, wherein said blade support frame member comprises:

a right blade mounting bracket mounted at said right end of said frame member; and a left blade mounting bracket mounted at said left end of said frame member; and wherein said members which are fixedly mounted on said blade support frame member comprise:

at least one rigid right rib member fixedly mounted onto said right blade mounting bracket, said right rib member also forming a portion of said upper snow plow blade;

at least one rigid left rib member fixedly mounted onto said left blade mounting bracket, said left rib member also forming a portion of said upper snow plow blade.

12. A trip edge snow plow blade as defined in claim 1, wherein said blade biasing members comprise:

a plurality of springs.

13. A trip edge snow plow blade as defined in claim 12, wherein said blade biasing members comprise:

four springs, wherein two of said springs are located on each side of said trip edge blade.

14. A trip edge snow plow blade as defined in claim 12, wherein said forces exerted by said plurality of springs to bias said trip edge blade are exerted in planes which are substantially orthogonal to said blade trip axis.

15. A trip edge snow plow blade as defined in claim 1, wherein said blade biasing members are mounted proximate planes which are orthogonal to said blade trip axis and located at points at which said trip edge blade is pivotally mounted on said blade support frame member.

16. A trip edge snow plow blade as defined in claim 1, additionally comprising:

a mechanism which limits the movement of said trip edge blade between said blade tripped position and said blade return position.

17. A trip edge snow plow blade as defined in claim 1, wherein said blade trip axis is located in a plane which is defined by said blade support frame member such that said blade trip axis is at substantially the said horizontal height as said blade support frame member.

18. A trip edge snow plow blade as defined in claim 1, wherein the forces exerted by said trip edge blade on said blade support frame member are essentially compressive in nature without a substantial torsional component.

19. A trip edge snow plow blade as defined in claim 1, wherein said trip edge blade is also pivotally mounted on said upper snow plow blade about said blade trip axis.

20. A trip edge snow plow blade as defined in claim 1, wherein said blade trip axis is located on a side of said trip edge blade which will face a vehicle when the snow plow frame is installed at the front of the vehicle.

21. A trip edge snow plow blade as defined in claim 1, wherein said trip edge blade is approximately ten inches (25.4 cm) high.

22. A trip edge snow plow blade as defined in claim 1, additionally comprising:

at least one first position limiting member located on said blade support member; and at least one second position limiting member located on said trip edge blade, said first and second position limiting members interacting to limit pivotal movement of said trip edge blade between said blade return position and said blade tripped position.

23. A trip edge snow plow blade as defined in claim 22, additionally comprising:

at least one cushion stop mounted on one of said first and second position limiting members, said cushion stop being located intermediate said first and second position limiting members at said blade tripped position and at said blade return position to absorbing a substantial portion of impact forces as said trip edge blade is driven to said blade trip position by an impact or to said blade return position by said blade biasing members.

24. A trip edge snow plow blade as defined in claim 22, wherein there are two first position limiting member located on said blade support member, two second position limiting member located on said trip edge blade, and a cushion stop mounted on both of one of said first position limiting members and said second position limiting members.

25. A trip edge snow plow blade as defined in claim 1, additionally comprising:

a wearstrip mounted on the front of said trip edge blade and extending downwardly and forwardly from said trip edge blade; and a back blade wearstrip mounted on the rear of said trip edge blade and extending downwardly and rearwardly from said trip edge blade.

26. A trip edge snow plow blade as defined in claim 1, wherein said blade biasing members are arranged and configured to provide a substantially linear progressively increasing force to said trip edge blade as it moves from said blade return position to said blade tripped position.

27. A trip edge snow plow blade, said trip edge snow plow blade being mounted on a snow plow frame which may be installed at the front of a vehicle, said trip edge snow plow blade comprising:

a blade support frame member having a right blade mounting bracket mounted at the right end of said frame member and a left blade mounting bracket mounted at the left end of said frame member, said blade support frame member being supported from the snow plow frame which may be installed at the front of the vehicle;

an upper snow plow blade fixedly mounted onto said right and left blade mounting brackets;

a trip edge blade pivotally mounted on said right and left blade mounting brackets, said trip edge blade being pivotable about a blade trip axis between a blade return position and a blade tripped position, wherein said trip edge blade is mounted at a location below said upper snow plow blade; and a plurality of blade biasing springs which exert forces to bias said trip edge blade from said blade tripped position to said blade return position.

28. A method of supporting a trip edge snow plow blade on a snow plow frame which is mounted on a snow plow frame which may be installed at the front of a vehicle, said method comprising:

supporting a blade support frame member having right and left ends, said blade support frame member being supported from the snow plow frame which is installed at the front of the vehicle;

fixedly mounting an upper snow plow blade on said blade support frame member;

pivotally mounting a trip edge blade on said blade support frame, said trip edge blade being pivotable about a blade trip axis between a blade return position and a blade tripped position, wherein said trip edge blade is mounted at a location below said upper snow plow blade; and exerting forces to bias said trip edge blade from said blade tripped position to said blade return position.

* * * * *

UNITED STATES PATENT AND TRADEMARK OFFICE

CERTIFICATE OF CORRECTION

PATENT NO. : 7,171,770 B2
APPLICATION NO. : 10/925806
DATED : February 6, 2007
INVENTOR(S) : Lynn W. Schultz et al.

It is certified that error appears in the above-identified patent and that said Letters Patent is hereby corrected as shown below:

Col. 32, Line 40: “trip” should be --tripped--

Signed and Sealed this

Sixteenth Day of October, 2007

JON W. DUDAS
*Director of the United States Patent and Trademark Office*